US009675895B2

(12) United States Patent
Judkins et al.

(10) Patent No.: US 9,675,895 B2
(45) Date of Patent: Jun. 13, 2017

(54) THREE WAY MULTIDIRECTIONAL INTERACTIVE TOY

(71) Applicant: Hasbro, Inc., Pawtucket, RI (US)

(72) Inventors: Daniel Judkins, Providence, RI (US); Kristofer Paulson, Providence, RI (US); Andrew Han, Boston, MA (US); Don Cameron, Riverside, RI (US); Jonathan Pale, Warwick, RI (US)

(73) Assignee: Hasbro, Inc., Pawtucket, RI (US)

( * ) Notice: Subject to any disclaimer, the term of this patent is extended or adjusted under 35 U.S.C. 154(b) by 386 days.

(21) Appl. No.: 14/205,048

(22) Filed: Mar. 11, 2014

(65) Prior Publication Data

US 2014/0273717 A1 Sep. 18, 2014

Related U.S. Application Data

(60) Provisional application No. 61/780,297, filed on Mar. 13, 2013.

(51) Int. Cl.

| | |
|---|---|
| ***A63F 9/24*** | (2006.01) |
| ***A63H 3/28*** | (2006.01) |
| ***A63H 3/00*** | (2006.01) |

(52) U.S. Cl.

CPC ..... *A63H 3/28* (2013.01); *A63H 3/006* (2013.01); *A63H 2200/00* (2013.01)

(58) Field of Classification Search

CPC ..... A63H 3/28; A63F 13/235; A63F 13/98; A63F 13/02; A63F 13/825

See application file for complete search history.

(56) References Cited

U.S. PATENT DOCUMENTS

| | | | | |
|---|---|---|---|---|
| 5,746,602 | A | 5/1998 | Kikinis | |
| 5,752,880 | A | 5/1998 | Gabai et al. | |
| 5,853,327 | A * | 12/1998 | Gilboa | A63F 3/00643 273/237 |
| 6,022,273 | A | 2/2000 | Gabai et al. | |
| 6,075,195 | A | 6/2000 | Gabai et al. | |
| 6,149,490 | A | 11/2000 | Hampton et al. | |
| 6,160,986 | A | 12/2000 | Gabai et al. | |
| 6,206,745 | B1 | 3/2001 | Gabai et al. | |
| 6,290,566 | B1 | 9/2001 | Gabai et al. | |
| 6,319,010 | B1 | 11/2001 | Kikinis | |
| 6,352,478 | B1 | 3/2002 | Gabai et al. | |
| 6,356,867 | B1 | 3/2002 | Gabai et al. | |
| 6,368,177 | B1 | 4/2002 | Gabai et al. | |
| 6,514,117 | B1 | 2/2003 | Hampton et al. | |
| 6,544,098 | B1 | 4/2003 | Hampton et al. | |
| 6,773,322 | B2 | 8/2004 | Gabai et al. | |
| 6,773,344 | B1 | 8/2004 | Gabai et al. | |
| 6,959,166 | B1 | 10/2005 | Gabai et al. | |
| 2006/0223637 | A1 * | 10/2006 | Rosenberg | A63F 13/10 463/47 |

(Continued)

*Primary Examiner* — Steve Rowland
(74) *Attorney, Agent, or Firm* — Perry Hoffman

(57) ABSTRACT

Systems and methods for interaction between a user and a plurality of toys is disclosed where an interactive physical toy character senses inputs from a player and from a virtual toy character in a virtual environment. The virtual toy character likewise senses inputs from a player and a physical toy character so that bidirectional, multi-way gameplay involving a player, a physical toy and a virtual toy in a virtual environment is achieved.

20 Claims, 10 Drawing Sheets

(56) References Cited

U.S. PATENT DOCUMENTS

| | | | | |
|---|---|---|---|---|
| 2007/0211047 | A1* | 9/2007 | Doan | A63F 1/04 345/419 |
| 2007/0265081 | A1* | 11/2007 | Shimura | A63F 13/10 463/37 |
| 2009/0197658 | A1* | 8/2009 | Polchin | A63F 13/02 463/9 |
| 2011/0098092 | A1* | 4/2011 | Reiche, III | A63F 13/02 463/1 |
| 2014/0100029 | A1* | 4/2014 | Reiche | A63F 13/12 463/31 |
| 2014/0121008 | A1* | 5/2014 | Canessa | A63F 13/02 463/29 |
| 2014/0179446 | A1* | 6/2014 | Zuniga | A63F 9/24 463/47 |

* cited by examiner

THREE WAY MULTIDIRECTIONAL INTERACTIVE TOY

PRIORITY CROSS-REFERENCE TO RELATED APPLICATION

This application claims priority pursuant to 35 U.S.C. 119(e) from U.S. Provisional Patent Application, No. 61/780,297 filed on Mar. 13, 2013.

FIELD OF THE INVENTION

The present invention relates to an interactive toy that goes beyond the seemingly life-like interactions between a toy and a user and further incorporates another dimension of interaction from a virtual character with a personality and emotions active within a virtual world residing on a smart device/computer and uniquely interactive with both the user and the toy.

BACKGROUND OF THE INVENTION

Many of the developments made to toy dolls and animals in recent years have focused on enhancing play for a child user by providing a certain amount of interaction between the user and the toy. To this end, providing an interactive toy with life-like and intelligent seeming interactions with a user is disclosed and exemplified in U.S. Pat. Nos. 6,514,117 and 6,544,098 to Hampton et al. for "Interactive Toy" issued Feb. 4, 2003 and Apr. 8, 2003, respectively, divided from parent U.S. Pat. No. 6,149,490, also to Hampton et al. for "Interactive Toy" issued Nov. 21, 2000, and all three sited patents are incorporated herein by reference.

The Hampton patents disclose a toy that incorporates a cam operating system provided with cam mechanisms associated with each movable body part for controlling movements thereof. The cam operating system includes a single control shaft driven for rotation by a single motor. This compact arrangement can be utilized for small sized toys while still precisely controlling and coordinating the movable body parts to provide life-like reactions and interactions with a user. Additionally, the single motor is reversible allowing body movements to occur in a non-cyclical pattern for more life-like responses compared to prior cycled responses.

The Hampton patents also disclose the use of sensors incorporated into the toy for detecting predetermined sensory inputs and for dictating movements of the movable body parts in response to the sensed inputs. Additionally, a programmable information processor for activating the reversible motor cooperates with the cam operating system to precisely control and coordinate movements thereof to provide a toy with life-like mannerisms.

The interactive toy as exemplified in the '098 Hampton patent, further discloses the incorporation of a speech synthesizer for audio interaction with the user, sound generating circuitry, and means for processing information in order to control the motor and speech synthesizer. The information processor in the toy provides a rudimentary artificial intelligence impacting verbal responses, language learning, motor operation and overall operating modes of the toy to provide life-like and intelligent interactions. The toy may operate in any one of a plurality of operating modes, incorporating a variety of look up tables, for example, in response to the processed information and the sensory inputs to modify the operation of the movable members and the audio interaction and thereby providing methods for interacting and exhibiting a maturing of the toy in response to the users interactions.

Specifically, as seen in the '098 patent, various artificial intelligence (AI) functions are provided. Sensor training is also provided in which training between the random and sequential weightings defines a random sequential split before behavior modification of the interactive toy, allowing the child to provide reinforcement of desirable activities and responses. In connection with the AI functions, appropriate responses to particular activities or conditions are provided, e.g., bored, hungry, sick, and sleep. Such predefined conditions have programmed responses which are undertaken by the interactive toy at appropriate times in its operative states. Additionally, as discussed, the interactive toy maintains its age (1-4) in a non-volatile memory, and can increment the age where appropriate.

Accordingly, summarizing the wide range of life-like functions and activities that the compact and cost-effective toy herein can perform to entertain and provide intelligent seeming interaction with a child, the following is a description of the various abilities the preferred toy has and some specifics in terms of how these functions can be implemented. The toy plaything is provided with the computer program which enables it to speak a unique language concocted exclusively for the toy plaything herein, such as from a combination of Japanese, That, Mandarin, Chinese and Hebrew. This unique language, called "Furbish" for example, is common to all other such toy playthings. When it first greets the child, the toy plaything will be speaking its own unique language. To help the child understand what the toy plaything is saying, the child can use the dictionary that comes with the toy plaything.

The toy plaything responds to being held, petted, and tickled. The child can pet the toy plaything's tummy, rub its back, rock it, and play with it, e.g., via sensory input buttons. Whenever the child does these things, the toy plaything will speak and make sounds using the speech synthesizer of the co-processor. It will be easy for the child to learn and understand Furbish. For example, when the toy plaything wakes up, it will often say "Da a-loh u-tye" which means "Big light up." This is how the toy plaything says "Good Morning!" Eventually, the toy plaything will be able to speak a native language in addition to its own unique language. Examples of native languages the toy may be programmed with include English, Spanish, Italian, French, German and Japanese. The more a user plays with the toy plaything, the more the toy plaything will use a native language.

The toy plaything goes through four stages of development. The first stage is when the child first meets the toy plaything. The toy plaything is playful and wants to get to know the child. The toy plaything also helps the child learn how to care for it. The second and third stages of development are transition stages when the toy plaything begins to speak in a native language. The fourth stage is the toy plaything's mature stage when it speaks in the native language more often but will also use its own unique language. By this time, the child and toy plaything will know each other very well. The toy plaything is programmed to want the child to play with it and care for it.

At various times the toy plaything is programmed to require certain kinds of attention from the child. Just like a child, the toy plaything is very good at letting people know when it needs something. If the toy plaything is hungry, it will have to be fed. Since it can talk, the child will have to listen to hear when the toy plaything tells the child it wants food. If the toy plaything says "Kah a-tay" (I'm Hungry), it will open its mouth so the child can feed it as by depressing its tongue. The toy plaything will say "Yum Yum" so the child will know that it is eating. As the child feeds the toy plaything, it might say "koh-koh" which means that it wants more to eat. If the child does not feed the toy plaything when it gets hungry, it will not want to play anymore until it is fed. When the toy plaything is hungry, it will usually want to eat 6 to 10 times. When the child feeds the toy plaything, he should give it 6 to 10 feedings so that it will say "Yum Yum" 6 to 10 times. Then the toy plaything will be full and ready to play.

If the child does not feed the toy plaything it is programmed to begin to get sick, e.g. The toy plaything will tell the child that it is sick by saying "Kah boo koo-doh" (I'm not healthy). If the child allows the toy plaything to get sick, soon it will not want to play and will not respond to anything but feeding. Also, if the toy plaything gets sick, it will need to be fed a minimum of 10-15 times before it will begin to get well again. After the toy plaything has been fed 10-15 times it will begin to feel better, but to nurse it back to complete health, the child will have to play with it. Just like a child, when the toy plaything feels better it laughs, giggles, and is happier. The child will know when the toy plaything is better because the toy plaything will say "Kah noo-loo" (Me happy) and will want to play games.

When the toy plaything is tired it will go to sleep. It will also tell the child when it is tired and wants to go to sleep. The toy plaything is usually quiet when it sleeps, but sometimes it snores. When it is asleep, it will close its eyes and lean forward. Sometimes the child can get the toy plaything to go to sleep by petting it gently on its back for a while. If the child pets the toy plaything between 10 and 20 times, it will hum "Twinkle, Twinkle" and then go to sleep. The child can also get the toy plaything to go to sleep by putting it in a dark room or covering its eyes for 10-15 seconds.

If the child does not play with the toy plaything for a while, it will take a nap until the child is ready to play again. When the child is ready to play with the toy plaything, he will have to wake the toy plaything up. When the toy plaything is asleep and the child wants to wake it up, he can pick it up and gently tilt it side to side until it wakes causing the tilt/invert sensor to resume from the low power mode. Sometimes, the toy plaything may not want to wake up and will try and go back to sleep after it is picked up. This is okay and the child just has to tilt the toy plaything side to side until it wakes up.

There are many ways to play with the toy plaything. The child and toy plaything can make up their own games or play some of the games and routines discussed herein which the toy plaything is already programmed to use. One game is like "Simon Says". During this game the toy plaything will tell the child what activities to do and then the child has to repeat them. For example, the toy plaything may say, "Pet, tickle, light, sound." The child has to pet the toy plaything's back, tickle its tummy, cover its eyes, and clap his own hands. As the child does each of these, the toy plaything will say something special to let the child know that he has done the right action. The special messages are: 1) for TICKLE the toy plaything will giggle; 2) for PET, it will purr; 3) for LIGHT, it will say "No Light"; and 4) for SOUND, it will say "Big Sound". When the child hears the toy plaything say these things or purr, he will know that he has done the right action. The first game pattern will have four actions to repeat. Then if the child does the pattern correctly, the toy plaything will reward the child by saying, "whoopee!", or by even doing a little dance. The toy plaything then will add one more action to the pattern. If the child does not do the pattern correctly, the toy plaything will say "Nah Nah Nah Nah Nah Nah!" and the child will have to start again with a new pattern.

To play, the toy plaything says, "Tickle my tummy", "Pet my back", "Clap your hands", or "Cover my eyes". When the child wants to play this game it is important that he waits for the toy plaything to stop moving and speaking after each action before doing the next action. Therefore, to get the toy plaything to play, after the child tickles it, the child should wait for it to stop moving before petting the toy plaything's back. Then after the child pets the toy plaything's back, the child should wait until it stops moving before the child claps his hands. If the child does the pattern correctly and gets the toy plaything to play the game, the toy plaything will say its name and "Listen me" so the child will know it is ready to play. If the child wants to play the game and follows the pattern and the toy plaything does not say its name and then "Listen me", the toy plaything is not paying attention to the child. The child will then have to get the toy plaything's attention by simply picking the toy plaything up and gently rocking it side to side once or twice. The child should then try again to play. Once the toy plaything is ready to play, it will begin to tell the child which pattern to repeat. The toy plaything can make patterns with up to 16 actions. If the child masters one pattern, the toy plaything will make up another new pattern so the child can play again and again. To end the game, pick up the toy plaything and turn it upside down. The toy plaything will then say "Me done" so the child will know to stop playing.

Additionally, as exemplified in the '117 Hampton patent, the sensors also allow several of the toys to interact with each other. The toys include control circuitry for allowing communications between the toys and the user, and wireless communications systems are further included and associated with the control circuitry of each toy to allow for toy-toy interaction. A signal generated by a first toy is sent to a second toy to initiate interaction therein by signaling the control circuitry of the second toy to indicate receipt and send back signal communications to the first toy causing toy-toy interactions. Toy-toy interaction can progress through the actuation of moveable members of the first and second toys by signaling the control circuitry of the other toy, thereby, for example, giving the appearance of the first and second toys dancing together. Also, producing sounds from the first toy can be actuated by signaling the control circuitry of the second toy and the generating of the external signal through the wireless communications of the second toy and coordinating the sounds produced from the first toy so that the two toys appear to be vocally responding.

Several other interactive toys and interactive toy technologies define systems, apparatuses and methods for orally communicative and tactile interaction between a person, a toy and a computer. In these known interactive toys, the function of the computer, or other smart device, has been to facilitate the communication, interaction, and development of the relationship between the end user and the toy, for example, by increasing the complexity of the vocabulary that may be used between the user and the toy, by defining commands that the user may present to the toy, by storing data related to the user-toy interaction, etc.

U.S. Pat. No. 5,746,602 to Kikinis for "PC peripheral interactive doll" issued May 5, 1998, relates to bi-directional communications with a microphone and speaker to fully enable a peripheral device embodied as a "personalized" entity, e.g., an interactive doll system. Through the execution of control routines by the CPU, communication is executed between the PC and the personalized entity as a peripheral device wherein stored audio is retrieved by the CPU, passed to the personalized entity via the communication link, converted to analog audio at the speaker in the personalized entity, and wherein voice input via the microphone in the personalized entity is converted to audio data by control circuitry, transferred to the computer via the communication link, and utilized at the computer in conjunction with the control routines to guide selection of stored audio data to be retrieved and sent to the personalized entity.

U.S. Pat. No. 5,752,880 to Gabai et al. for "Interactive doll" issued May 19, 1998, relates to controlling a toy that carries out at least one action via a computer system that uses a first wireless transmitter to command the toy to perform an operation and that receives feedback pertaining to performance of the operation by transmitting from the toy to the computer a second transmission via a second wireless transmitter.

U.S. Pat. No. 6,022,273 to Gabai et al. for "Interactive doll" issued Feb. 8, 2000, relates to a wireless computer controlled toy system operative to transmit a first transmission from a computer via a first wireless transmitter and at least one toy including a first wireless receiver, the toy receiving the first transmission via the first wireless receiver and operative to carry out at least one action based on the first transmission. Also, a method for generating control instructions involves selecting a command from a plurality of toy-related commands and generating at least one command that either instructs the toy to verbally prompt a user or commands the toy to await a verbal response from the user before transmitting the verbal response to the computer.

U.S. Pat. No. 6,075,195 to Gabai et al. for "Computer system having bi-directional midi transmission" issued Jun. 13, 2000, relates to a wireless computer controlled toy system that transmits and receives MIDI data and operates to carry out an action based on wireless transmissions. This system allows a wireless computer to control a computer controlled toy wirelessly using a MIDI interface.

U.S. Pat. No. 6,290,566 to Gabai et al. for "Interactive talking toy" issued Sep. 18, 2001, relates to a toy with developing skills including a figure having capacity to perform an action with control circuitry operative to control the figure at different levels of skill. This invention discloses a computer controlled toy system that interacts with a computer controlled fanciful figure via a bidirectional speech communication link to translate speech in a first language from the fanciful figure to the computer to speech returned from the computer to the fanciful figure in a second language using software to translate from one language to another and to develop language where no translation is available.

U.S. Pat. No. 6,319,010 to Kikinis for "PC peripheral interactive doll" issued Nov. 20, 2001, relates to providing a communication link by coupling communication ports for direct command communication and direct voice communication between a host computer and an interactive personal article, such as a doll, that includes a speaker for reproducing sounds and/or actuators for moving parts. In these embodiments, the interactive personal article, such as a doll, is viewed by the computer as a peripheral device.

U.S. Pat. No. 6,352,478 to Gabai et al. for "Techniques and apparatus for entertainment sites, amusement parks and other information and/or entertainment dispensing sites" issued Mar. 5, 2002, relates to an amusement park apparatus including entertainment providing nodes with a node controller, or computer, operative to assign each player to individual games. These techniques and apparatuses define a communications network that creates associations between amusement park game players, games chosen by the game players, and nodes associated with particular games where node controllers provide for game playing interaction between the game players and the nodes, where a node may present an animated computer controlled character.

U.S. Pat. No. 6,356,867 to Gabai et al. for "Script development systems and methods useful therefor" issued Mar. 12, 2002, relates to generating scripts having verbal content for a computer-controllable animated figure with script elements each representing an action. The system includes a graphics based user interface that allows a user to define scripts having verbal content that allow a computer to control a computer controllable animated physical figure.

U.S. Pat. No. 6,368,177 to Gabai et al. for "Method for using a toy to conduct sales over a network" issued Apr. 9, 2002, relates to methods for using a toy for effecting sales over a public network by employing interactive speaking and listening functions. The method includes providing a toy having interactive speaking and listening functionality, connecting the toy via a public network to at least one server having transactional functionality, and using the interactive speaking and listening functionality of the toy to provide salesmanship.

U.S. Pat. No. 6,206,745 to Gabai et al. for "Programmable assembly toy" issued Mar. 27, 2001, and U.S. Pat. No. 6,773,322 to Gabai et al. for "Programmable assembly toy" issued Aug. 10, 2004, relate to a programmable assembly toy including a multiplicity of toy elements which are joinable to define a player selectable structure. The player may select several toy elements to define and build a structure where some of the toy elements are controllable and to use a player programmable control system to control the controllable toy elements that are part of the player defined structure.

U.S. Pat. No. 6,773,344 to Gabai et al. for "Methods and apparatus for integration of interactive toys with interactive television and cellular communication systems" issued Aug. 10, 2004, relates to integrating interactive toys with interactive television, computer, or cellular mobile communication systems and allowing the television, computer, or cellular mobile communication systems to send control commands to the toy.

U.S. Pat. No. 6,160,986 to Gabai et al. for "Interactive toy" issued Dec. 12, 2000, and U.S. Pat. No. 6,959,166 to Gabai et al. for "Interactive toy" issued Oct. 25, 2005, relate to an interactive toy apparatus including speech recognition for receiving speech inputs from the user employing an interactive content controller using information relating to the user's preferences received via the user input receiver and stored in the user information storage unit for providing interactive audio content via the toy. Computer systems and interactive teaching techniques are used with these verbally interactive toys for logging information received from user inputs at toys in relation to individual past interactions for information to control the toys. The resident software in the toy uses scripts defining branching between alternative user sections in response to any of a user input, an environmental condition, a past interaction, personal information related to a user, speech recognition, a remote computer, and a time related condition to personalize and advance the verbal and tactile interaction between the user and the toy. The toy uses a plurality of motor controlled facial features at different positions and different rates to generate an illusion of different emotions. Thus, a user's combination of personal inputs through direct interaction between the user and the toy define a personalized combination of scripts that give the toy a user prompted personality.

Significantly, the above described improvements in the inter-activeness of a seemingly responsive toy have continuously evolved and have further enhanced play for a user. The addition of cam operating systems, for example, to a relatively small interactive toy has allowed for movement of numerous movable body parts of the toy to enhance the life-like and seemingly intelligent reactions of the toy. Further, the addition of sensors, IR technologies, and a programmable information processor for actuation of the cam system in the toy has added to the responsiveness and more appropriate and life-like toy interactions. Two interactive toys may now also react to one another. The addition of a speech synthesizer for audio interaction with the user, sound generating circuitry, and means for processing information in order to control the motor and speech synthesizer has provided a rudimentary artificial intelligence in the toy for impacting verbal responses, language learning, motor operation and overall operating modes of the toy to provide life-like and intelligent interactions.

Additionally, the incorporation of a computer/smart device to interactions with the toy impacted the orally communicative and tactile interaction between the user and toy. Interactive toys which utilize a computer/smart device provide for the computer/smart device to facilitate the communication, interaction, and development of the relationship between the user and the toy, for example, by increasing the complexity of the vocabulary that may be used between the user and the toy, by defining commands that the user may present to the toy, or by storing data related to the user-toy interaction, etc. Further integration of other numerous technologies, as described above, into interactive toys has also provided for real time conversations between toys and the user and manipulation of the toy by the computer as well as by the user. The computer, or other smart device of known interactive toys has not been used to provide an interface to another virtual character residing on the device with a personality that can interact with both the player and the physical toy.

Accordingly, it would be desirable to further incorporate another dimension of interaction from a virtual character with a personality and emotions active within a virtual world residing on a computer/smart device and uniquely interactive with both the user and the toy. The inventions discussed in connection with the described embodiment address these and other deficiencies of the prior art.

The features and advantages of the present inventions will be explained in or apparent from the following description of the preferred embodiment considered together with the accompanying drawings.

SUMMARY OF THE INVENTION

The present inventions address the deficiencies of the prior art of interaction between users and toy characters. A described embodiment further incorporates another dimension of interaction from a virtual character with a personality and emotions active within a virtual world residing on a computer/smart device and uniquely interactive with both the user and the toy. The present described embodiment goes beyond real time conversations between the user and the toy to further incorporate another dimension of events and even the personality of a virtual character which can effect reactions and moods and even the physical display of emotions in the physical toy. Such interaction would be desirable to enrich the experience of the player by providing for a networked interaction between three parties, the player, the physical toy character, and the virtual toy character.

In a described embodiment, this type of networked interaction, the interaction between the user, or player, and the physical toy character, is enhanced by adding a virtual character on a smart device and providing for three-way, bidirectional interaction between 1) the player and the physical toy character, 2) the player and the virtual toy character, and 3) the physical toy character and the virtual toy character. It is also contemplated that this network may be expanded into a multi-way network involving one or more players, one or more physical toy characters, or one or more virtual characters. Thus, in response to an interaction between the player and the virtual toy character, the virtual character may communicate with the physical toy character, and the physical toy character may respond. For example, the popular physical toy character Furby™, produced by Hasbro, may be enhanced by allowing for a virtual Furby™ character to interact with the player and with the physical toy character.

The Furby™ physical toy character allows for the interaction between a player and a physical character as described above with reference to the Hampton patents. Such interaction allows a relationship between a player and a physical toy character to develop and mature using artificial intelligence, for example, by providing for the player and the toy to learn each other's language, by providing for the player to respond to the toy's life-like "wants" and "needs", and by providing for various stages of maturation to develop the relationship.

This relationship may be enhanced by providing for the creation and development of a virtual Furby™ type character or other type of virtual character that can develop a personality and mature on a computer/smart device. For example, in the described embodiment, the virtual character may begin as an egg that a player earns from the physical toy character, a friend's physical toy character, or from a virtual toy character. A player may store several eggs in a virtual egg carton and selectively choose eggs to "incubate". The player will then incubate the egg until it is ready to hatch. When the egg hatches, it has certain personality traits imprinted on it. These personality traits come from the physical toy character. The player then nurtures the baby virtual character by feeding it, cleaning it and playing with it. If no physical toy character is present during imprinting, the virtual toy character's personality is chosen randomly. Once the virtual character matures, it moves to a "neighborhood". In some embodiments, the virtual character may interact with other virtual characters in the player's collection. During the interactions between the player and the virtual character, both the player and the virtual character may communicate in a bidirectional manner with the physical toy character, and all three participants may be responsive to an interaction between any two participants.

During the incubation process, an egg will appear on the touch screen of the smart device. Once in incubation, the egg begins a countdown until the hatching using an egg timer. During this time, the player has to attend to the egg to allow "imprinting", and the physical toy must provide affection to the egg. This requires a three-way network for bidirectional communication between and among the player, the egg, and the physical toy. For example, during incubation, the player must touch the egg lightly. In response, the egg will wobble gently as if it has been poked. While the egg is being attended by the player, imprinting must occur, which requires the physical toy to show affection to the egg. If the physical toy is placed near the smart device, the physical toy will interact with the egg by communicating its presence. This communication may occur using radio or sound signals or any other available communication means. To show the communication and that the physical toy is providing affection, hearts will appear in the physical toy's eyes, followed by hearts appearing around the egg. During imprinting, data corresponding to the physical toy's personality is transferred to the egg through the smart device. Thus, when the egg hatches, and a baby virtual character appears, the baby virtual character will absorb the physical toy's personality.

In some embodiments, a player may cause imprinting by providing headphones for the egg and purchasing and playing themed music within the game. For example, when a player reaches a first imprinting event, the player may be prompted with a menu of the following choices: 1) for free, the physical toy character sings for the egg to imprint the physical toy character's personality onto the egg; 2) for a fee, pop music is played and a princess trait is imprinted; 3) for a fee, rock music is played and a rocker trait is imprinted; 4) for a fee, hip-hop music is played and a tough-girl trait is imprinted; 5) for a fee, techno music is played and a spastic trait is imprinted; and 6) for a fee, polka music is played and a glutton trait is imprinted. Once a certain genre of music is purchased, it is removed from the menu. If the player chooses to use a physical toy character to imprint for free, the electronic device signals the physical toy character to sing a song for its current personality type. The physical toy character's trait is then imprinted on the egg, and corresponding visuals are played. Afterwards, the hatching meter continues to progress. If the player chooses to purchase one of the other traits, the chosen trait is imprinted, and the corresponding visuals and audio are started on the electronic device. The hatching meter continues to progress while these audio-visuals play. This process repeats until the meter is full and the egg is ready to hatch.

Also, during the incubation process, the egg will communicate graphically and audibly with the player to express its needs. For example, if the egg is cold, the player will see icicles around the egg. The player may then rub a finger across the egg to warm it, and the egg will provide audio and visual feedback to tell the player that it is warm. Likewise, if the egg is scared or dirty, it will notify the player and the player can attend to the egg with physical touching. When the egg expresses its needs, the egg also communicates with the physical toy to express those needs. Correspondingly, the physical toy reacts audibly to show its concern. Once the player addresses the egg's needs, the egg again communicates with the physical toy, and the physical toy reacts with happiness and relief.

Following incubation, when the egg timer reaches zero, the egg is fully imprinted and hatches. To speed up the hatching, the player may tap the egg as it is cracking Hatching may also be speeded up with certain in-app purchases. After hatching, the player is asked to name the new baby virtual toy character. When the player chooses the name, the physical toy reacts by speaking the baby's name.

After the baby hatches, nurturing of the virtual character begins. Nurturing requires the player to feed, clean, groom and entertain the baby. All these activities develop the baby's personality and abilities to communicate and prepare the baby for joining the neighborhood of other virtual characters. To accomplish feeding the baby, the player may interact with the smart device by touching a designated area to access a screen with a blender and food, where the player may concoct a smoothie for the baby. Feeding the baby allows the baby to accumulate points towards achieving its maturity. Likewise, the player may touch designated areas of the smart device to groom the baby, to toilet train the baby, or to play with the baby. During nurturing, the baby will express its moods and desires to the player both visually and audibly. For example, the baby may express anger, happiness, hunger, illness, etc. Again, the physical toy is also in communication with the virtual character and can also express its emotions, such as happiness, concern, anger, etc. Additionally, the player may also interact with the physical toy to address the physical toy's behavior, such as stroking it when it is concerned or angry or feeding it when it is hungry.

A dashboard may be provided to allow the player to view statistics and progress related to the physical toy character, the virtual toy character and the virtual environment and that acts as a central hub by providing links to all areas of the game. Neglecting the baby of required nurturing will slow the process of preparing the baby for the neighborhood. During the nurturing process, the physical toy may monitor the activities and react both physically and audibly.

When the virtual character is fully nurtured, it joins the player's collection of virtual baby characters in a neighborhood, where the player and the physical toy can interact with each previously raised baby. Each baby may have distinct personalities reflecting the imprinting.

In described embodiments, the physical toy is the driving force behind the described game play, and the overall player progression is measured by the level of development of the physical toy. The physical toy's level is affected and increased through various actions in the game, mainly through raising and nurturing a baby as well as through the player feeding and cleaning the physical toy. As the level of the physical toy increases, more content becomes available for interacting with the virtual character and with the physical character.

From the foregoing, one is provided with a unique interactive toy that integrates an additional dimension to provide for multi-way, bidirectional interaction between three or more entities, such as a user, a physical toy character, and a virtual toy character. The virtual toy character originates and matures within an application residing on a "smart" device or computer and uniquely interacts with both the user and the physical toy character. For example, the physical toy character can appear to hatch a virtual toy character into the smart device by contacting the device at a time in which the physical toy character indicates to the user that it is ready to lay an egg and incubate it to hatch. The virtual toy character will acquire its own personality and emotions and become active within its virtual world on the computer/smart device. The needs and wants of the virtual toy character can be expressed to the user and/or the physical toy character and the personality of the virtual toy character can effect reactions and moods in the physical toy character. The physical toy character can exhibit a physical display, for example, a symbol displayed in the eyes of the physical toy character, indicating the physical and emotional state of the virtual toy character. The physical toy character will then be transformed or matured by the virtual toy character as the moods and needs of the virtual toy character are addressed. The physical toy character is also able to adapt to changes or improvements to the application on the electronic device, e.g. with new software download or by unlocking content on the physical toy.

Various embodiments provide a system for interaction between a user and a plurality of toys. The systems of these embodiments include an interactive physical toy character having a first sensor for detecting predetermined sensory inputs to the physical toy character and for generating signals corresponding to the sensory inputs. Circuitry in the physical toy character is used for responding to signals from the first sensor. A first transmitter in the physical toy character is used for transmitting predetermined electronic communications signals in response to signals from the first sensor.

The systems of these embodiments further include an electronic device having a plurality of second sensors for detecting predetermined sensory inputs to the electronic device. The electronic device also has a second receiver for receiving predetermined electronic communications signals from the physical toy character and a second transmitter for transmitting predetermined electronic communications signals to the physical toy character in response to signals from the second sensors and in response to signals received by the second receiver.

A virtual environment exists within the electronic device of the described systems having environmental attributes that change in response to signals from the second sensors and in response to signals received by the second receiver. Also in these embodiments, a virtual toy character exists on the electronic device in the virtual environment having character attributes that change in response to signals from the second sensors, in response to signals received by the second receiver and in response to changes in the virtual environment.

The described embodiments may include a larger network having plurality of users, a plurality of physical toy characters and a plurality of virtual toy characters. For example, in some embodiments, the player and the physical toy character may interact with a third-party, a third-party's virtual toy character or a third-party's physical toy character using the Internet, LAN, or other type of network.

The circuitry in the physical toy character that is used for responding to signals from the first sensor may further be used with: 1) a plurality of sensors for detecting predetermined sensory inputs to the physical toy character and for generating signals corresponding to the sensory inputs; 2) a first receiver for receiving predetermined electronic communications signals into the physical toy character; 3) circuitry for responding to signals received by the first receiver; 4) the first transmitter further transmitting predetermined electronic communications signals in response to signals from the first sensors and in response to signals received by the first receiver; 5) sound generating circuitry that responds to signals from the first sensors and signals received by the first receiver; 6) light generating circuitry that responds to signals from the first sensors and signals received by the first receiver; and 7) movement generating circuitry that responds to signals from the first sensors and signals received by the first receiver.

In some described embodiments, the virtual toy character is a virtual egg. The virtual egg is earned into the virtual environment because of interaction between a user and the physical toy character. The changes to character attributes give the virtual egg a personality. The virtual egg provides visual and auditory responses to interactions with the user and the physical toy character. The changes to character attributes also cause the virtual egg to hatch and release a virtual baby offspring. When the virtual egg hatches, it acquires character attributes resembling character attributes from the physical toy character.

From the foregoing, the described embodiments may include a simple physical toy character that has one sensory input, such as a single button that when pressed causes the physical toy character to talk so that the player may hear, and that sends signals to communicate to the virtual toy character or to another physical toy character. For example, the simplified physical toy character may be limited to passing a virtual egg to the virtual environment and communicating its presence to another physical toy character and the player. The described embodiments may also include a more complex physical toy character that includes full kinetic circuitry, the ability to mature and develop personality, light and sound inputs and outputs, etc.

Embodiments may further have user-touchable areas in the virtual environment that initiate activities in the virtual environment involving the user, the physical toy character and the virtual toy character, such as feeding, grooming, toilet training and playing with the virtual toy character. A dashboard may be used in the virtual environment to displays statistics related to the physical toy character, the virtual toy character and the virtual environment and that acts as a central hub by providing links to all areas of the game.

Certain embodiments are enhanced by having virtual objects locked in the virtual environment that become unlocked in response to one of a scanned code and auditory tones or other signals. The code may be on the physical toy, packaging or some other object. The auditory tones or other signals may also come from the physical object or another object. Promotional virtual eggs, already hatched virtual toy characters, virtual food and themes and items for the virtual environment are also offered in described embodiments to enhance a player's experience. Enhanced experiences may also be achieved by embodiments with locked virtual gift packages that become unlocked in response to a virtual egg hatching or a three-way interaction between the user, the physical toy character and the virtual environment. Additionally, virtual currency earned from interaction with the virtual toy character may be used to spend in the virtual environment to purchase virtual objects.

Other described embodiments define a network for toy play between a user, a physical toy and a virtual toy. The physical toy is an interactive physical toy character with a developmental personality that matures in response to interaction with a user and a virtual toy character. The virtual toy character has a developmental personality that matures in response to interaction with a user and a physical toy character. The networks in these embodiments may have a plurality of users, a plurality of physical toy characters and a plurality of virtual toy characters.

In some described embodiments of these networks, the physical toy character has a plurality of first sensors for detecting predetermined sensory inputs to the physical toy character and for generating signals corresponding to the sensory inputs. The physical toy character also has a first receiver, used for receiving predetermined electronic communications signals into the physical toy character. Circuitry in the physical toy character is used for responding to signals from the first sensors and for responding to signals received by the first receiver. A first transmitter in the physical toy character is used for transmitting predetermined electronic communications signals in response to signals from the first sensors and in response to signals received by the first receiver.

The networks of these embodiments further include an electronic device having a plurality of second sensors for detecting predetermined sensory inputs to the electronic device. The electronic device also has a second receiver for receiving predetermined electronic communications signals from the physical toy character and a second transmitter for transmitting predetermined electronic communications signals to the physical toy character in response to signals from the second sensors and in response to signals received by the second receiver.

A virtual environment exists within the electronic device of the described networks having environmental attributes that change in response to signals from the second sensors and in response to signals received by the second receiver. Also in these embodiments, a virtual toy character exists on the electronic device in the virtual environment having character attributes that change in response to signals from the second sensors, in response to signals received by the second receiver and in response to changes in the virtual environment.

Some network embodiments include a virtual egg as the virtual toy character that hatches and releases a virtual baby offspring in response to the interaction with the user and the physical toy character. In further embodiments, when the virtual egg hatches, it acquires a personality resembling the personality of the physical toy character.

Some network embodiments further have a dashboard in the virtual environment that displays statistics and progress related to the physical toy character, the virtual toy character and the virtual environment and that acts as a central hub by providing links to all areas of the game.

The described embodiments include a method for interaction between a user and a plurality of toys that provides an interactive physical toy character capable of detecting predetermined sensory inputs to the physical toy character and generating signals corresponding to the sensory inputs with a plurality of first sensors, receiving predetermined electronic communications signals into the physical toy character into a first receiver, providing circuitry for responding to signals from the first sensors and for responding to signals received by the first receiver, and transmitting predetermined electronic communications signals in response to signals from the first sensors and in response to signals received by the first receiver with a first transmitter.

The method further provides an electronic device capable of detecting predetermined sensory inputs to the electronic device with a plurality of second sensors, receiving predetermined electronic communications signals from the physical toy character with a second receiver, transmitting predetermined electronic communications signals to the physical toy character in response to signals from the second sensors and in response to signals received by the second receiver with a second transmitter, providing a virtual environment comprising environmental attributes that change in response to signals from the second sensors and in response to signals received by the second receiver, and providing a virtual toy character comprising character attributes that change in response to signals from the second sensors, in response to signals received by the second receiver and in response to changes in the virtual environment.

The method ties everything together by providing a dashboard in the virtual environment that displays statistics and progress related to the physical toy character, the virtual toy character and the virtual environment and that acts as a central hub by providing links to all areas of the game.

The matter set forth in the foregoing description and accompanying attachments is offered by way of illustration only and not as a limitation. The above examples do not represent a complete description of all the available details and interaction.

BRIEF DESCRIPTION OF THE DRAWINGS

The inventions will now be more particularly described by way of example with reference to the accompanying drawings. Novel features believed characteristic of the inventions are set forth in the claims. The inventions themselves, as well as the preferred mode of use, further objectives, and advantages thereof, are best understood by reference to the following detailed description of the embodiment in conjunction with the accompanying drawings, in which:

DETAILED DESCRIPTION OF THE EMBODIMENTS

Figure 1A:
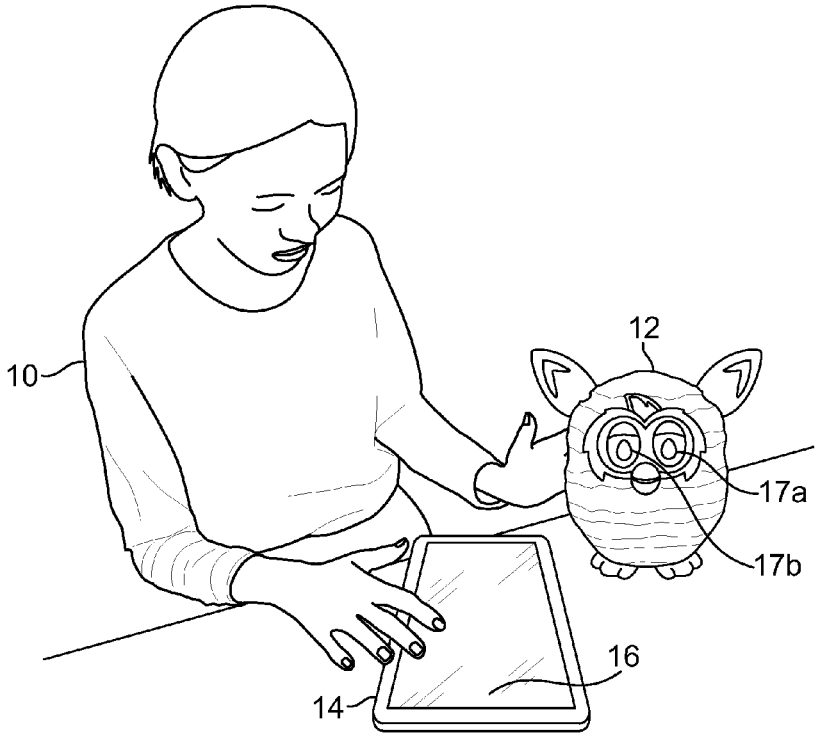
FIG. 1A shows an elevated perspective view of a user, a physical toy character and an electronic device interacting to transfer an egg from the physical toy character to the electronic device.

The described embodiment is a game providing for interaction between a human player, a physical toy character and a virtual toy character in a virtual environment on an electronic device. More specifically, the described embodiment uses an interactive physical toy, such as a Furby™, which is manufactured by Hasbro™, that develops a personality, matures and communicates with players audibly, visually and kinetically. The interactive physical toy can also communicate with a virtual toy character in a virtual environment on an electronic device, for example, using wireless signaling or code scanning. The goal of the game is for the player to find and hatch virtual eggs that are offspring of the physical toy character, nurture each virtual hatchling, and build and raise a collection of virtual toy characters. The eggs are incubated and hatched on the electronic device. Collecting virtual toy characters provides rewards that allow the player to unlock ways to find more eggs. The overall goal of the game is for the player to find, nurture, and collect every virtual toy character.

The core gameflow cycle consists of five stages: 1) find an egg by earning an egg or receiving and egg as a gift; 2) transfer the egg into an egg carton for storage while the player continues collecting eggs and nurturing other eggs; 3) incubate the egg until it is ready to hatch; 4) nurture the hatchling by feeding it, cleaning it, and playing with it; and 5) move the virtual toy character into a virtual neighborhood of virtual toy characters. When a nurtured virtual toy characters moves into the neighborhood, the player receives rewards to help find rarer and higher-level eggs. In addition, utilities that only involve the player's physical toy character provide rewards that aid the player and ensure that every step of the game cycle feeds into the next level, creating a strong and clear experience. Different types of neighborhoods may exist with different themes and looks to add to the game.

The described embodiment has several features, including a dashboard to provide an overview and the current status of the toy characters, a naming facility for naming the toy characters, minigames where the player, the physical toy character and the virtual toy character all play, utilities, egg transferring from the player's physical toy character, from a friend's physical toy character or from a virtual toy character, egg storage, egg hunt scanning, device to device egg gifting, egg incubation, personality combining, in-game shopping, virtual toy character collection display, playroom customization, multiple physical toy character mode, multiple language support, and game-related analytics.

Game play begins by running an application on the electronic device and choosing to play with the physical toy character, which prompts communication between the electronic device and the physical toy character to confirm that the physical toy character supports the application. If the physical toy character supports the application, all information about the player's physical toy character is presented in the dashboard. To collect the required information, the player must scan the physical toy character. Upon starting the scanning process, the screen displays feedback. It is made to appear as though the scanning is being performed outwards from the smart device towards where physical toy character is placed. During the scanning process, the application attempts to obtain the physical toy character's information via wireless communication. To create anticipation, the scanning process lasts a few seconds even if the information is obtained very quickly. If, after several seconds, no information has been received, an error message is presented. The player is informed of the failure and is given advice on how to improve conditions. After dismissing the error message, the player is returned to the scanning screen to try again. After the scanning process is successfully completed, confirmation is presented to the player before automatically progressing to a naming screen.

Once the information is scanned from the physical toy character, the player must assign a name to the physical toy character. The naming screen interface consists of a "back" button that returns the player to previous screen. The naming screen interface also includes two rotational wheels that display prefixes and suffixes that can be combined to form a name and a submit button to confirm the name and to continue. For example, the first wheel may allow a player to select prefixes such as "AH" or "BEE", and the second wheel may allow a player to select suffixes such as "BAY" or "BOH". Thus, the possible names for the character are "AHBAY", "AHBOH", "BEEBAY" and "BEEBOH". The player can swipe each wheel up and down until the desired combination is found. The naming screen interface further includes a "submit" button to confirm the name and to continue to the next screen. As the wheels are rotated to a new name, the meaning of the name is displayed. Once the player has selected a name, the physical toy character voices the name and the game continues to the dashboard. Each time the naming screen is presented, the wheels begin on a random combination. Certain combinations are disallowed due to profanity in allowable languages.

To earn the first egg, the player must start a game in the virtual environment on the electronic device to gain experience and to set the level on the physical toy character. When the game in the described embodiment starts, the player is prompted with a utility, such as a hose utility, where experience may accumulate and an egg may be earned. When an egg is earned, the electronic device, which may be a computer or other smart device, prompts the physical toy character to start the egg transfer sequence, which causes an virtual egg to appear on the screen of the smart device. After the egg is transferred, an egg carton is shown holding the transferred egg and other eggs in the player's collection. The player may make a selection to start the incubation stage. When the incubation stage starts, the physical toy character must "egg-sit" the incubating egg by being placed in front of the electronic device. The first egg takes an extremely short amount of time to hatch and only requires one imprinting from the physical toy character. Whatever personality the physical toy character has when incubation starts is imprinted onto the egg. Once reaching the incubation stage, the player is free to return to the dashboard and browse the other options and features. After the egg-sitting is complete, the player removes the physical toy character and the egg begins to crack open on the screen. The player can interact with the hatching egg by tapping and swiping the cracked egg shell. As the virtual toy character emerges from the egg, its type is revealed. The first hatched virtual toy character looks like its parent.

So nurturing may begin, the newly hatched virtual toy character is immediately shown in a playroom. The player interacts with the virtual toy character through different activity types to add some progress to its level. The player may then begin finding and collecting other eggs.

Finding and collecting eggs is part of the core gameplay cycle and allows the player to eventually achieve all types of virtual toy characters in the neighborhood. There are several ways to collect eggs: 1) from the player's own physical toy character; 2) from the player's friends' physical toy characters; 3) through virtual toy characters that exist within the game and can be unlocked over time; 4) scanning in promotional eggs from the real world; 5) device-to-device egg gifting; and 6) from other toys. Once collected, eggs are added to an egg carton that stores the eggs until they are ready for incubation. Duplicate eggs may be selected if the player has collected them from another player.

In some embodiments, the player's physical toy character can periodically produce new eggs that can be transferred into the game. Generating eggs is intrinsically linked to the physical toy character's overall level, and each time it moves up a level, it has the ability to produce another egg. Although the physical toy character's level is increased by various actions within the game, successfully nurturing and raising a virtual toy character from a hatchling contributes the most progress towards producing a new egg. When an egg has been earned and is available for transfer, it is communicated to the player by the physical toy character. It is possible for a physical toy character to accumulate multiple eggs if the player does not transfer an egg after each instance of increasing a play level. Whenever an uncollected egg is available, it is reflected on the dashboard.

A simpler version of the described embodiments may be limited to having one virtual egg to transfer, one sensory input, such as a button, one output to the player, such as sound, and one signal to the physical toy character, such as an indication of the simpler toy's presence.

When a player accesses the egg transferring screen, the smart device communicates with the physical toy character to begin the transfer. During the transfer, the physical toy character displays particles that form an egg in its eyes while a particle animation occurs on-screen on the smart device as if the egg is being transferred. When the particles have formulated into an egg, the transfer is complete. The egg is then placed into the egg carton and the player is taken to a screen showing the egg carton.

FIG. 1A shows an elevated perspective view of a user 10, a physical toy character 12 and an electronic device 14 interacting to transfer an egg from the physical toy character 12 to the electronic device 14. The player 10 has placed the physical toy character 12 adjacent to the electronic device 14. The player 10 selects to transfer an egg from a menu option on the screen 16 or by directly selecting the physical toy character level meter on the screen when an egg is available. The physical toy character 12 and the electronic device 14 communicate wirelessly. The physical toy character 12 shows egg images 17*a-b* in its eyes, and particles begin to form an egg on the screen 16 as if the particles are being transferred to the electronic device 14. If an egg transfer is attempted and after several seconds the electronic device 14 has failed to communicate with the physical toy character 12, a hint is displayed on the screen 16 that explains that the physical toy character 12 must be properly positioned near the electronic device 14.

Figure 1B:
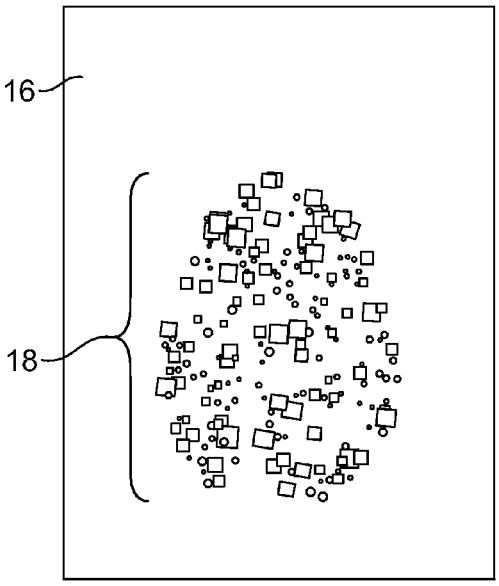
FIG. 1B shows a screen shot of a virtual egg forming.
Figure 1C:
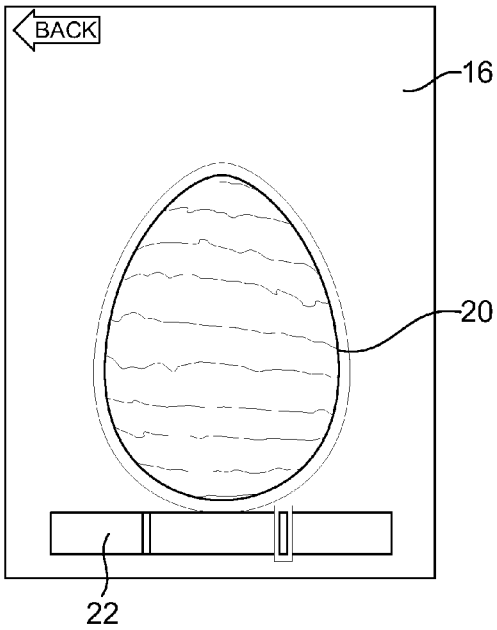
FIG. 1C shows a screen shot of a virtual egg.

FIG. 1B shows a screen shot of a virtual egg forming. The particles 18 are shown materializing in an egg-shape on the screen 16 in a virtual environment. The transfer is complete when the egg has fully materialized. FIG. 1C shows a screen shot of a virtual egg 20 in the virtual environment. The fully materialized virtual egg 20 on the screen 16 may now be transferred to a virtual egg carton for storage and may begin incubating. An egg timer 22 may be used to show the progress of the virtual egg 20 towards hatching. Messages may appear on the screen 16 to instruct the player that the virtual egg 20 has been received. A button may appear on the screen to allow the player add the virtual egg 20 to a virtual egg carton.

Figure 2:
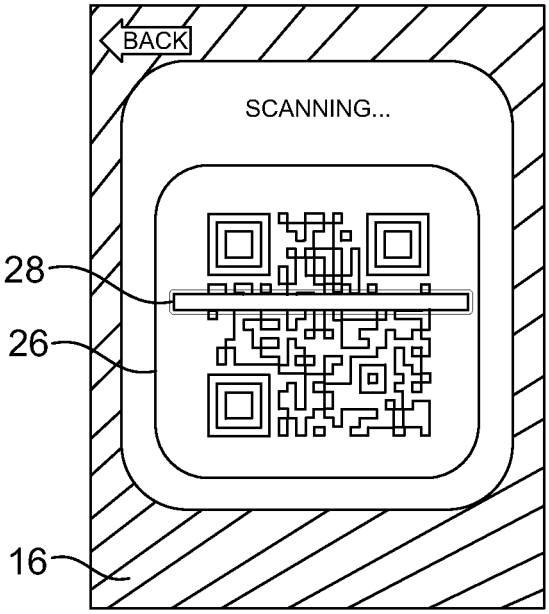
FIG. 2 shows a screen shot of the electronic device scanning a QR code.

In some embodiments, virtual objects, such as virtual eggs and other things to enhance the virtual environment, may be scanned into the virtual environment using the camera on an electronic device to scan codes in the physical environment. For example, a promotional egg hunt may be part of a marketing campaign and may allow a player to scan QR codes found in the real world, and eggs can be found hidden among posters, flyers, magazines, bus shelters, shop windows and many other places. When a player finds an egg, it can be scanned into the game and placed in the egg carton. The player is then able to hatch and nurture this virtual egg until it moves into its own unique location in the neighborhood. FIG. 2 shows a screen shot of the electronic device scanning a QR code 26. As the player is scanning a QR code with a camera, an image of the QR code 26 appears on the screen 16. A scanning bar 28 may be used to show the progress of the QR code processing and/or the virtual egg transfer.

Virtual eggs also may be received from friends' physical toy characters, which may also be transferred into the game. The benefit of receiving an egg from a friend is that it helps the player complete a collection from another tribe of physical toy characters and unlocks the corresponding virtual friend if not already unlocked. As with the player's physical toy character, the friend's physical toy character must transfer the egg into the game. This process is very similar to transferring from the player's physical toy character. The only difference is that the player must select to receive a gift from the appropriate menu. A similar egg transfer sequence is then presented, and the egg is placed into the egg carton. In the described embodiment, the player is only able to get an egg from a friend's physical toy character after a cool down period of five hours has expired. As the player does not need to do anything in game to earn eggs from a friend's physical toy character, the cool down period is necessary to prevent spamming of the feature. If a player attempts to transfer an egg before the cool down period has expired, an error message appears.

Figure 3:
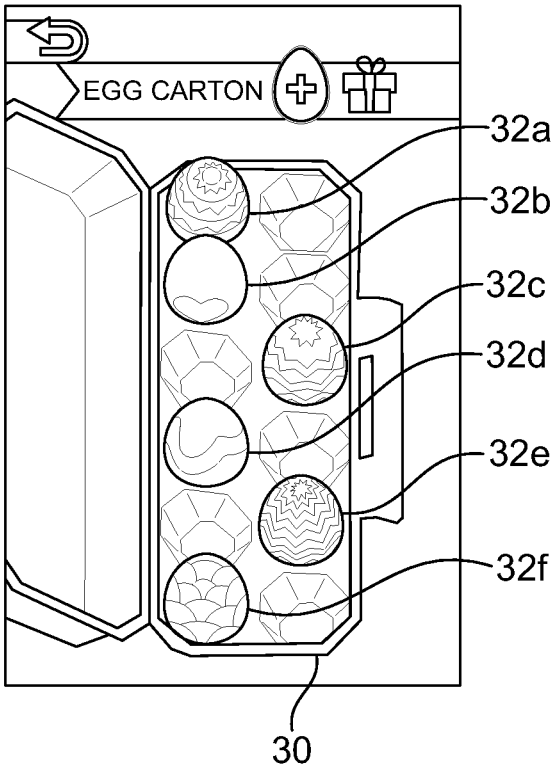
FIG. 3 shows a screen shot of a virtual egg carton with stored virtual eggs.

FIG. 3 shows a screen shot of a virtual egg carton 30 with stored virtual eggs 32*a-f*. The virtual egg carton 30 serves as a storage method for collected virtual eggs 32*a-f*. Stored virtual eggs 32*a-f* are collected in the virtual egg carton 30 before they are incubated. The purpose of the virtual egg carton 30 is to allow players to continue collecting eggs in various ways while another egg is incubated. Before incubating one of the stored virtual egg 32*a-f*, the player selects it from the virtual egg carton 30. Upon touching one of the stored virtual eggs 32*a-f*, the player confirms that the egg will be incubated. When an egg is already incubating or a hatchling is being nurtured, an egg cannot be moved into the incubator and a message explaining this is displayed when the egg is touched. The virtual egg carton 30 can store up to 12 eggs. Once the virtual egg carton 30 is full, the player may not add any more eggs until at least one has been removed. If the player attempts to transfer an egg from a physical toy character or to receive an egg by any other means when the virtual egg carton 30 is full, a message is presented. When it is not possible to transfer an egg, the egg remains available for transfer and the player does not lose any credit or virtual currency. The player can make space in the egg carton 30 by selecting a stored virtual egg 32*a-f* to incubate, gifting a stored virtual egg 32*a-f* to a friend, or deleting a stored virtual egg 32*a-f*.

Players are also able to transfer stored virtual eggs 32*a-f* between their virtual egg cartons 30 without the use of the physical toy character. Stored virtual eggs 32*a-f* are transferred using wireless communication and do not require the use of a data connection or player accounts. Gifting from electronic device to electronic device makes it easy to share stored virtual eggs 32*a-f* with friends and complete a virtual toy character collection more quickly. The player can send a stored virtual egg 32*a-f* to a friend when there are one or more eggs present in the virtual egg carton 30. To send stored virtual egg 32*a-f*, the player's friend must also have a smart device nearby that is running the same application and that is viewing the virtual egg carton 30. The player chooses a stored virtual egg 32*a-f* to send, and the details are sent to the friend's smart device via wireless signaling, such as tones. When one of the stored virtual eggs 32*a-f* has been successfully received by the friend's smart device, a confirmation message is presented and one of the stored virtual egg 32*a-f* is removed from the player's virtual egg carton 30. When receiving a virtual egg from a friend, it is added to the player's virtual egg carton 30. To receive a virtual egg, the player must be running the same application and viewing the friend's virtual egg carton while the friend initiates the transfer process. A message informs the player that the virtual egg is being gifted, and its details are sent to the player's smart device via wireless signaling, such as tones. When the virtual egg has been successfully received, a confirmation message is presented and the virtual egg is added to the player's virtual egg carton 30. The virtual egg is transferred between devices using wireless signaling, such as tones. The following unique tones are required: 1) initiate egg transfer (from sender to receiver); 2) received egg (from receiver to sender); and 3) declined egg (from receiver to sender). The details of the egg type are also communicated wirelessly.

When a player initiates virtual egg gifting, the 'initiate egg transfer' tone is sent first and the virtual egg type details immediately follow this. The sender then waits for either a 'received egg' or 'declined egg' tone from the receiver. If neither signal is received after several seconds, the operation times out and the virtual egg is not transferred from the sender's device. The receiver only has the ability to accept the virtual egg gift once it has successfully received both the 'initiate egg transfer' signal and the details of the egg type. If the friend declines the virtual egg, the player is informed with a message. The option to dismiss the message returns the player to the virtual egg carton 30. If the player does not receive either a received tone or a declined tone, it will eventually time out after several seconds. When this occurs, a generic message is presented prompting the player to either cancel or try the process again. If the player's virtual egg carton 30 is full, the friend is unable to send a gifted virtual egg. A message appears informing the player of this and the option to dismiss the message declines the virtual egg gift.

Figure 4:
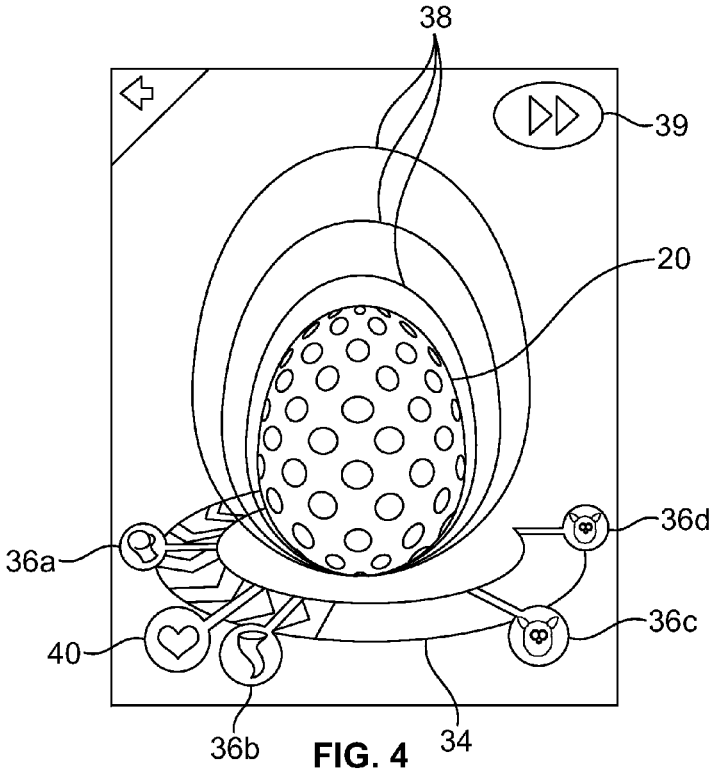
FIG. 4 shows a screen shot of a virtual egg during incubation with attention points displayed.

Once a virtual egg is stored in the virtual egg carton 30, it can be selected for incubation. FIG. 4 shows a screen shot of a virtual egg 20 during incubation with attention points 38 displayed. Once in incubation, the virtual egg 20 begins a countdown to hatching via the egg timer 34. During this time, the player has to attend to the virtual egg 20 for imprinting. Imprinting requires the physical toy character's affection so that the virtual egg 20 receives a personality from the physical toy character. During incubation, certain problems concerning the virtual egg 20, known as attention points, arise that the player must resolve. The amount of imprinting and attention points increase as virtual eggs with higher levels are collected. During imprinting, the virtual egg 20 absorbs the physical toy's current personality. With virtual eggs at higher levels, different combinations of personalities are available. When the virtual egg 20 is ready to hatch, the player can lightly interact with the shell to help hatching. It is then ready to be given a name before being transported into the playroom.

The incubator is where the player looks after the virtual egg 20 until it is ready to hatch. During incubation, the player is able to lightly interact with the virtual egg 20. The incubator also includes an egg timer 34, imprinting indicators 36*a-d*, attention points 38, and personality absorption during imprinting. When the player touches the virtual egg 20, the virtual egg 20 gently wobbles as if it has been poked. This light interaction is disabled when an attention point occurs and during hatching.

The egg timer 34 informs the player how long it will take for the virtual egg 20 to hatch. This counts down in real time whether or not the game is played. The egg timer 34 also has imprinting indicators 36*a-d* to indicate when imprinting is required from the physical toy character. Although attention points 38 appear on the egg timer 34, these are random events. Previously completed imprinting is represented by imprinting indicators such as 36*a* and 36*b* to show which personality was absorbed into the virtual egg 20. Future imprinting is indicated by imprinting indicator 36*c* and imprinting indicator 36*d*.

In some embodiments, virtual egg 20 hatching time may be a fixed interval, such as one minute. In other embodiments, virtual egg 20 hatching time is based on the player's level of play. The higher the level, the longer the virtual egg 20 takes to hatch. Higher levels add more time, more imprinting, and the possibility of more attention points.

Imprinting is an important part of the incubation process and reflects the outcome of a virtual toy character when it hatches from the virtual egg 20. When imprinting is required, the virtual egg 20 starts to yearn for the physical toy character's affection and reacts accordingly. The physical toy character then interacts with the virtual egg 20, showing hearts in its eyes. During imprinting, the virtual egg 20 absorbs the physical toy character's personality. This means that when the virtual toy character hatches from the virtual egg 20, it has the personality that the physical toy character had when imprinting was performed. More imprinting with higher level virtual eggs allows the player to add different personality combinations to create a more unique virtual toy characters. A player may choose a different personality by spending virtual currency or other types of accumulated credit. The egg timer 34 freezes until the virtual egg 20 has been successfully imprinted.

During imprinting, the physical toy character reacts in different ways. For example, when the virtual egg 20 is ready for imprinting, the physical toy character reacts with sounds of affection and hearts in its eyes. If the physical toy character's personality is used, the physical toy character sings during imprinting. When imprinting completes successfully, the virtual egg 20 absorbs the personality of the physical toy character and reacts positively.

An attention point 38 may occur as a random effect on the virtual egg 20 that can happen at any stage on the egg timer 34. An attention point 38 pauses the egg timer 34, causing progress to stop until the player has resolved a situation. In FIG. 4, the attention point 38 shows that the virtual egg 20 needs love from the player or the physical toy character, and the attention point indicator 40 shows that the love is being provided. Each attention point is resolved by player interaction. If the virtual egg 20 is cold, which is indicated by icicles on the virtual egg 20, the player must rub the virtual egg 20 with a finger to warm it. Visual and audio feedback communicate that the virtual egg 20 is warm again and the virtual egg 20 returns to its normal appearance. If the virtual egg 20 is scared or lonely, shown by the virtual egg 20 shaking or trembling, the player must stroke the virtual egg 20 to comfort it. The player comforts the egg by stroking a finger over the egg until it settles. Visual and audio feedback communicate that the egg is comforted and the egg returns to its normal appearance. If the virtual egg 20 is dirty, which is shown by dust on the virtual egg 20, the player must swipe the dirt away to clean it. Visual and audio feedback communicate that the egg is clean and the egg returns to its normal appearance. Attention points occur more frequently at higher levels. There is also a greater chance of an attention point occurring when the player remains in the incubator than when the player is elsewhere in the game.

While a player is playing the game, it is possible for the player to make in-app purchases. For example, a player may play in a mode where the physical toy character is not used. In that situation, virtual eggs take longer to hatch. Consequently, the player is able to purchase a "fast-forward" to lessen the incubation time. FIG. 4 shows a fast forward button 39 that can be pressed when enabled to accelerate incubation. The player will know that the fast forward button 39 is enabled when a number appears below the button. The number reflects the number of in-app "fast-forwards" that the player has. In some embodiments, when a player begins play in a mode without a physical toy, the player may be supplied with a number of "fast-forwards" to let the player learn how the "fast-forwards" work. Once a player has used the free "fast-forwards", if the player tries to use another "fast-forward", the player will be prompted to purchase more "fast-forwards" or to connect a physical toy character to the game. To prevent over-purchasing, a player may be restricted to purchasing a certain number of "fast-forwards" and not purchasing more until the current supply is used. Other purchases may include getting keys to unlock an apartment in the neighborhood or upgrading the virtual toy character's personality.

When an attention point has occurred and the player is viewing the virtual egg 20 in incubation, the physical toy character reacts with concern. After successfully resolving an attention point, the physical toy character reacts with happiness and relief. When the physical toy character has completed the final imprinting, the egg timer 34 finishes and a virtual toy character is ready to hatch from the virtual egg 20. The egg timer 34 disappears and a particle animation occurs around the virtual egg 20 as if something magical is happening.

As the virtual egg 20 begins to crack open, the player can lightly interact by tapping at the shell. Eventually, the virtual egg 20 bursts open, and the virtual toy character appears. The hatching process is very magical for the player, and during this time there is a lot of interaction between physical toy character and the virtual toy character.

Figure 5A:
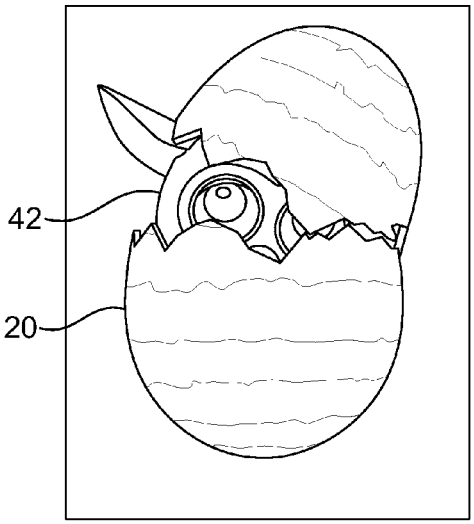
FIG. 5A shows a screen shot of a virtual egg hatching.

FIG. 5A shows a screen shot of a virtual egg 20 hatching. During hatching, the shell on the virtual egg 20 begins to crack open, and the virtual toy character 42 appears with pieces of shell on it. During this time, the player can lightly interact with the virtual toy character 42 by touching the virtual egg 20 to help it crack open. After a few seconds, the virtual toy character 42 bursts out of the egg. As described above, the virtual toy character 42 is now ready for naming before being transferred to the playroom.

After hatching, the virtual toy character 42 is automatically transferred into the playroom where it lives while being nurtured. This provides a platform where the player can interact with the virtual toy character 42 and also view information about its current level and status. The player can perform various actions when the virtual toy character 42 needs attention. When the virtual toy character 42 is hungry, the player can feed it using a blender, or feeding, utility. When the virtual toy character 42 is dirty, the player can clean and groom it using a spa utility. When the virtual toy character 42 is bored, the player can play with it by using one of several minigames.

The virtual toy character 42 lives in the playroom while it is being nurtured. The playroom is made to look similar to a bedroom, with various props and decorations. From the playroom, the player is able to interact with the virtual toy character 42, as well as access utilities and minigames. While in the playroom, the player is able to lightly interact with the virtual toy character 42 in three ways. The player is able to touch the virtual toy character 42 with a single, quick tap with one finger. The player is able to stroke the virtual toy character 42 with a repetitive rubbing action for at least two cycles with one or more fingers, and the player is able to drag a quick swipe with a single finger moving a certain distance away from the point of origin. Each movement elicits a different reaction from the virtual toy character 42.

Figure 5B:
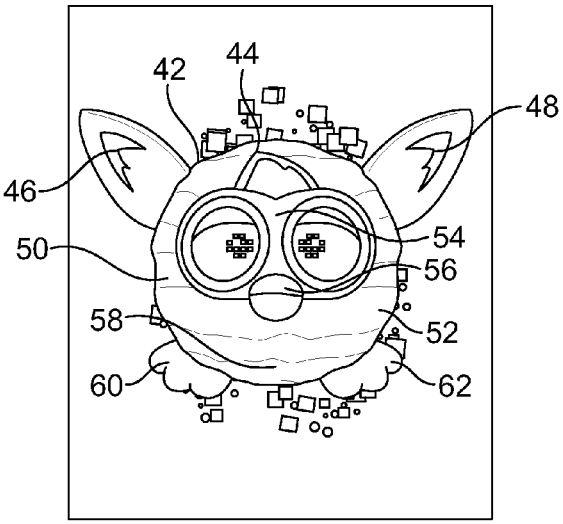
FIG. 5B shows a newly hatched virtual toy character.

FIG. 5B shows a newly hatched virtual toy character 42. While the newly hatched virtual toy character 42 is in the playroom, the player may touch, stroke or drag various body parts of the newly hatched virtual toy character 42, including the head 44, the left ear 46, the right ear 48, the left body 50, the right body 52, the eyes 54, the mouth 56, the belly 58, the left foot 60 and the right foot 62. Not all movement/body part combinations elicit a response.

Figure 5C:
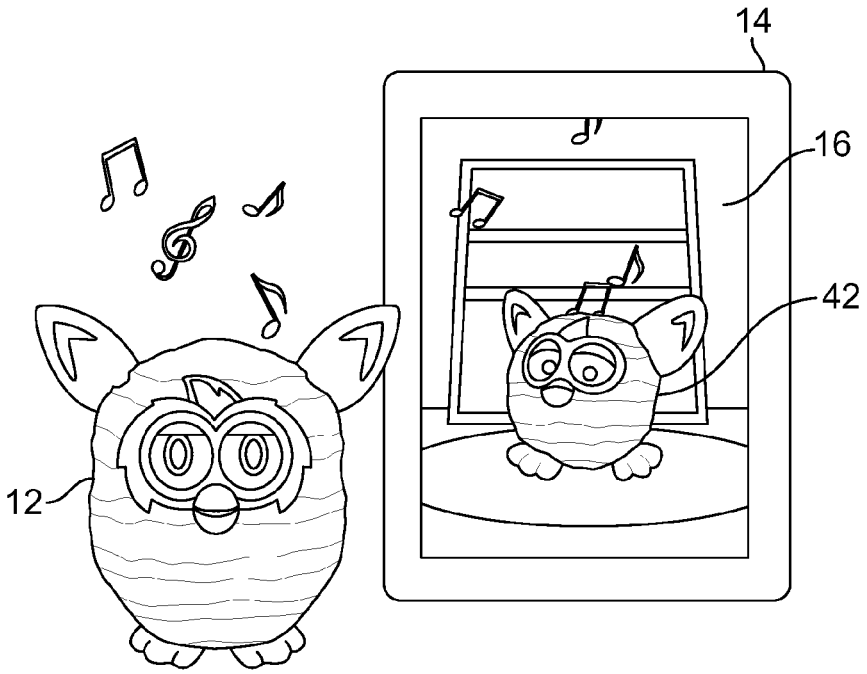
FIG. 5C shows an interaction between a physical toy character and a virtual toy character.

FIG. 5C shows an interaction between a physical toy character 12 and a virtual toy character 42. The virtual toy character 42 is shown in the playroom of a virtual environment on the screen 16 of an electronic device 14. If the virtual toy character 42 is left idle for several seconds, an interactive sequence plays where the virtual toy character 42 starts to cry and the physical toy character 12 sings to make the virtual toy character 42 happy. The virtual toy character 42 sings back if the physical toy character is present. If the physical toy character 12 is not present, the virtual toy character 42 will eventually stop crying on its own and return to its idle state.

Figure 6:
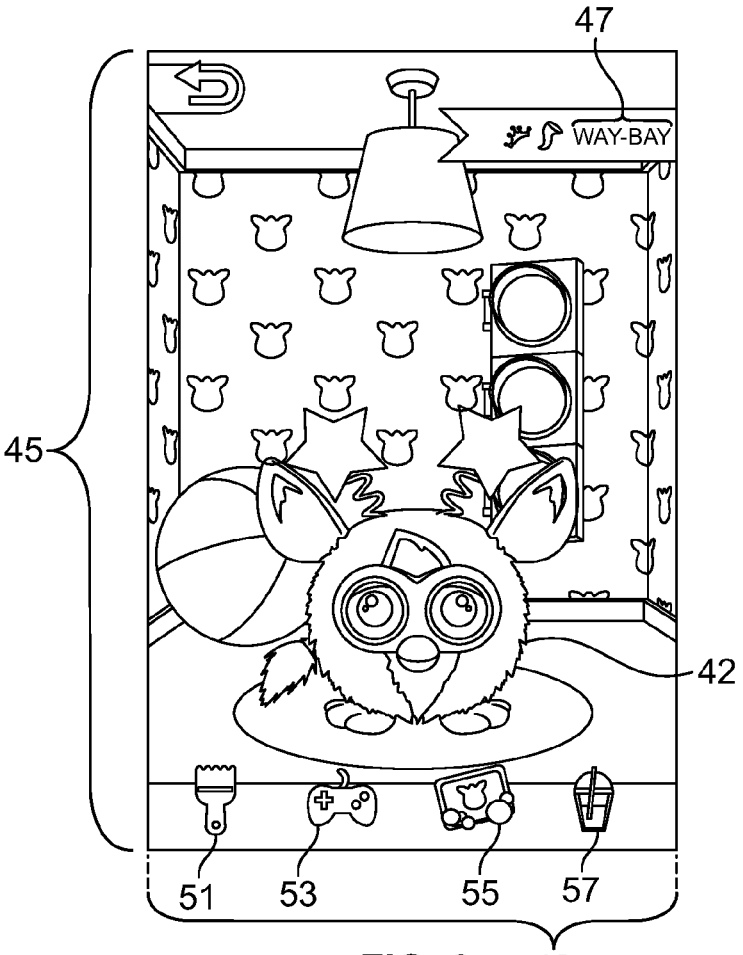
FIG. 6 shows a screen shot of a virtual toy character in a playroom.

FIG. 6 shows a screen shot of a virtual toy character 42 in a playroom 45. The virtual toy character 42 lives in the playroom 45 while it is being nurtured. The playroom 45 is made to look similar to a bedroom, with various props and decorations. While the virtual toy character 42 is in the playroom, the player is able to lightly interact with the virtual toy character 42 as described above with reference to FIG. 5B. The playroom 45 shows the virtual toy character's name tag 47 and offers access to playroom utilities 49, which may include a decoration utility 51 to redecorate and customize the playroom 45, a minigames utility 53, a video utility 55, and a feeding utility 57.

While nurturing, the player's goal is to successfully raise the virtual toy character 42, explore its type and personality, and bring it to its full potential. There are statuses of the virtual toy character 42 that are tracked, and when a certain status needs attention, it is a message to the player to perform actions in the game. Statuses deteriorate based on time, and the player improves them by using utilities and minigames. When using the utilities and minigames, progress is made towards adding the virtual toy character 42 to the neighborhood.

When the virtual toy character 42 needs attention, it is communicated through statuses, such as hunger, cleanliness and play. Hunger status relates to how much the virtual toy character 42 needs to eat something. This is improved in the game by using the feeding utility 57 to feed the virtual toy character 42 a meal. Cleanliness status relates to how dirty the virtual toy character 42 is and whether or not it requires cleaning and grooming. This is improved in the game by using a spa utility to clean and groom the virtual toy character 42. Play status relates to how much the virtual toy character 42 has been played with recently. This can be improved in the game by using the minigames utility 53. Each status has a three-level traffic light system behind-the-scenes that denotes how much attention the virtual toy character 42 needs. Green is good and means no attention is required. Amber is okay and means that the virtual toy character 42 needs some attention, but it is not urgent. Red is bad and means that the virtual toy character 42 needs urgent attention. Statuses decay over time and move from green to amber to red. Each status may decrease at its own defined rate, and also moves from green to amber and amber to red at different rates. The status timer resets if the player uses a utility or minigame. Performing the corresponding minigame or utility immediately improves the virtual toy character's status by one step (i.e. 'amber' improves to 'green', 'red' improves to 'amber' and requires more action to get it to 'green'). Any use of a minigame or utility improves the status by one step, regardless of what the player did (e.g. the player does not need to get a high score in a minigame to improve the 'Play' status). Any statuses that are already green are unaffected by use of utilities and minigames. Playing utilities and minigames advances the virtual toy character's overall progression towards the neighborhood. Depending on how the player performs, more progress is added. The progression towards the neighborhood is represented on the virtual toy character's dashboard. There are five different possible outcomes of the utilities in the described embodiment, each contributing a different amount of progress. Those outcomes are negative for no progress, indifferent for a small amount of progress, slightly positive for a medium amount of progress, positive for a large amount of progress, and very positive for very large amounts of progress.

Using the utilities allows the player to discover what each virtual toy character 42 likes and dislikes, as well as improving the virtual toy character's statuses and earning progress. In the described embodiment, there are two utilities, the blender, or feeding, utility for when the virtual toy character 42 is hungry and the spa utility for when the virtual toy character 42 is dirty. Each utility has elements of exploration for the player where the virtual toy character 42 reacts differently accordingly to its personality.

The feeding utility consists of a blender and a menu of items, including some which are free and some with price tags. The player helps the virtual toy character 42 eat, and the physical toy character may have a reaction.

Figure 7A:
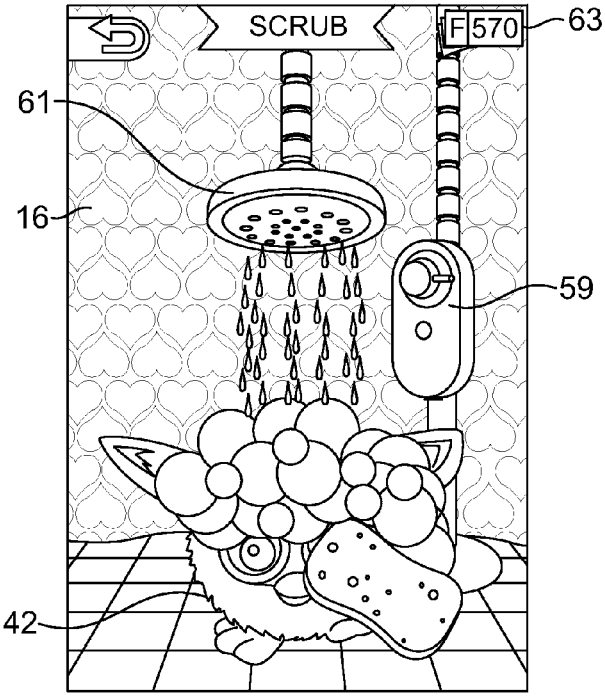
FIG. 7A shows a screen shot of a virtual toy character taking a shower at a virtual spa.

The spa utility consists of a shower and a menu of lotions, potions, cleaning products, styling items and accessories to clean the virtual toy character 42. FIG. 7A shows a screen shot of a virtual toy character 42 taking a shower at a virtual spa. The virtual toy character 42 is shown on the screen 16 of the electronic device, lathered and scrubbing itself. A virtual shower faucet 59 controls the flow of water on the screen 16 from a virtual shower head 61. A virtual currency indicator 63 indicates how much currency the virtual toy character 42 has to spend at the spa while accessing the spa's menus.

Figure 7B:
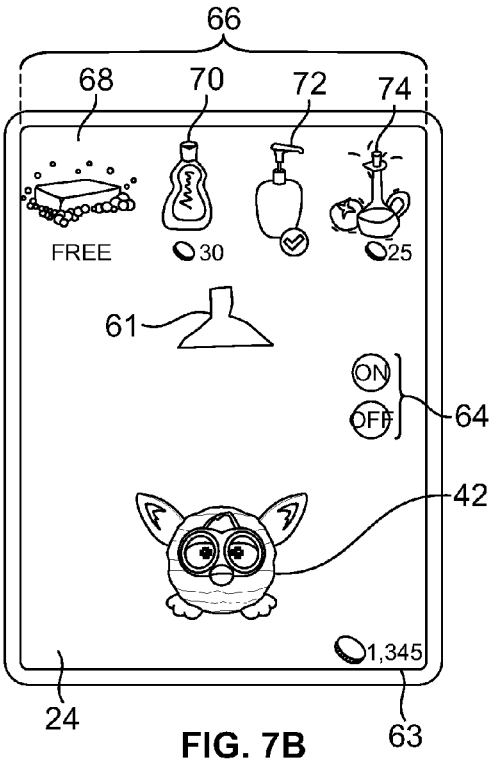
FIG. 7B shows a screen shot of a menu for selecting cleaning fluids while the virtual toy character is in the virtual shower at the virtual spa.

FIG. 7B shows a screen shot of a menu for selecting cleaning fluids while the virtual toy character 42 is in the virtual shower at the virtual spa. There is a virtual shower head 61 that can start automatically or be controlled with virtual shower on/off buttons 64 that are activated on a touch screen 24. The user interacts with the touch screen 24 to help the virtual toy character 42 get clean. The virtual currency indicator 63 displays how much the player may spend buying items shown on the conveyor belt menu 66. In the displayed conveyor belt menu 66, the player may help the virtual toy character 42 use bar soap 68, which is free, shampoo 70, which costs 30 currency units, liquid soap 72, which has been selected and paid for, and oil and tomato 74, which costs 25 currency units and adds a touch of humor. To select an item from the menu, the player may touch the item on the touch screen 24. The virtual currency indicator 63 will reflect that an item was purchased.

Figure 7C:
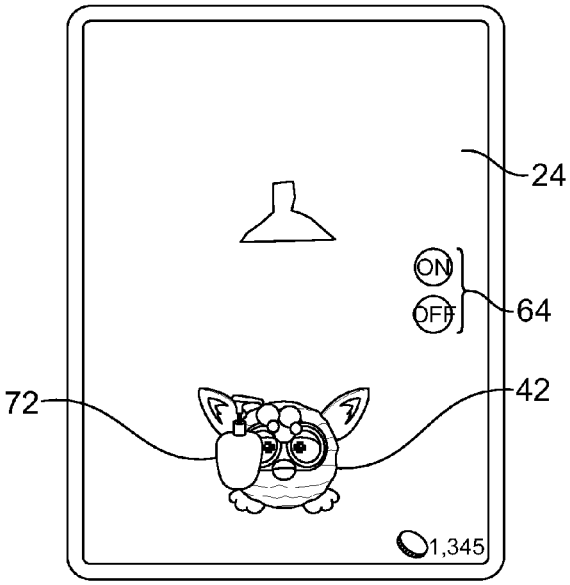
FIG. 7C shows the virtual toy character applying liquid soap to itself in the virtual shower.
Figure 7D:
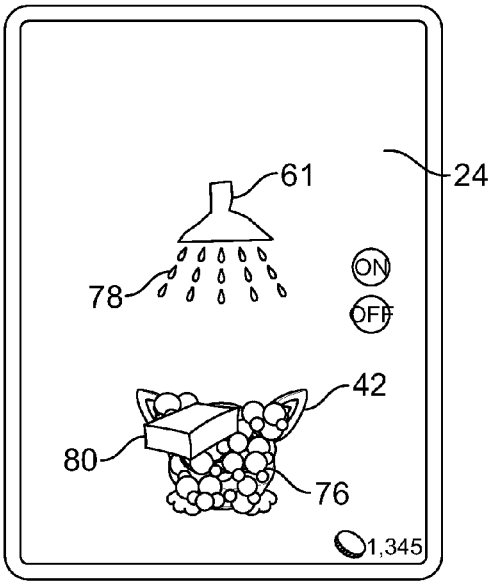
FIG. 7D shows the virtual toy character washing itself with a sponge.

FIG. 7C shows the virtual toy character 42 applying liquid soap 72 in the virtual shower. The player uses the touch screen 24 to make the soap lather. Once the virtual toy character 42 applies the liquid soap 72, the water may start automatically, or the player may start the water on the touch screen 24 by using the virtual shower on/off buttons 64. After the virtual toy character 42 applies the liquid soap 72, the player may use the touch screen 24 to select a scrubbing tool, such as a brush or a sponge. FIG. 7D shows the virtual toy character 42 washing itself with a sponge 80. The player has used the touch screen 24 to select the sponge 80. The virtual toy character 42 is shown in full lather 76 and about to rinse with water 78 from the shower head 61. In the described embodiment, the virtual toy character 42 must be covered in the full lather 76 and fully rinsed to get completely clean and make the most progress nurturing. After the virtual toy character 42 is fully rinsed, it is removed from the shower to a styling area where the player may choose a styling tool and may interact with the virtual toy character 42 to style its fur. When the player finishes grooming, the virtual toy character 42 may respond with an opinion on the grooming, and the physical toy character may also respond.

Figure 7E:
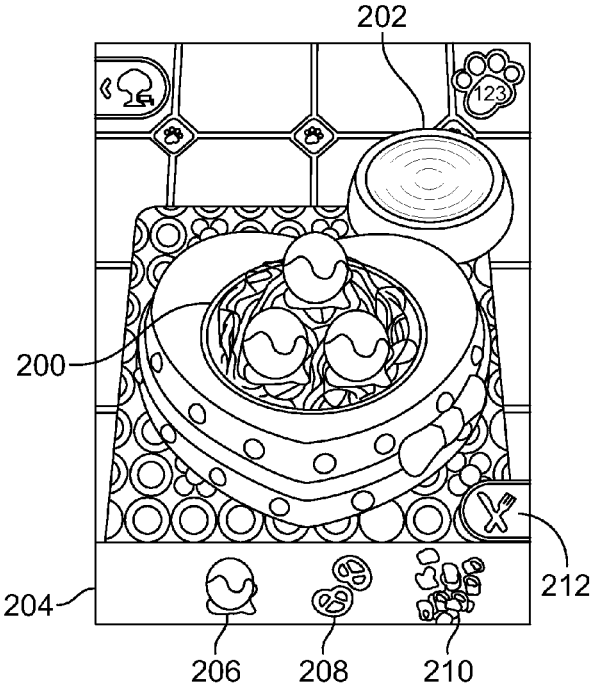
FIG. 7E shows a screen shot of a virtual meal for a physical toy dog.
Figure 7F:
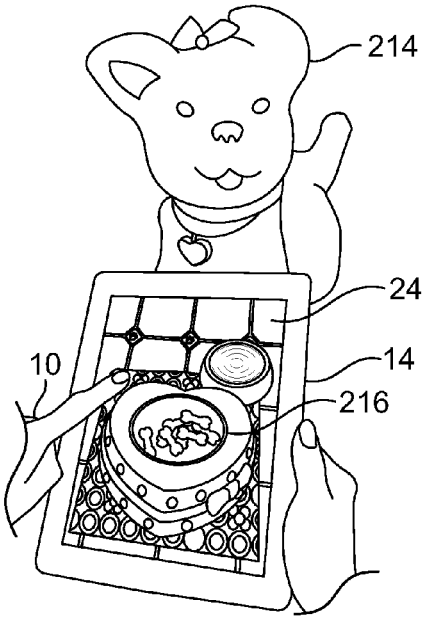
FIG. 7F shows the player preparing to feed a virtual snack to the physical toy dog.
Figure 7G:
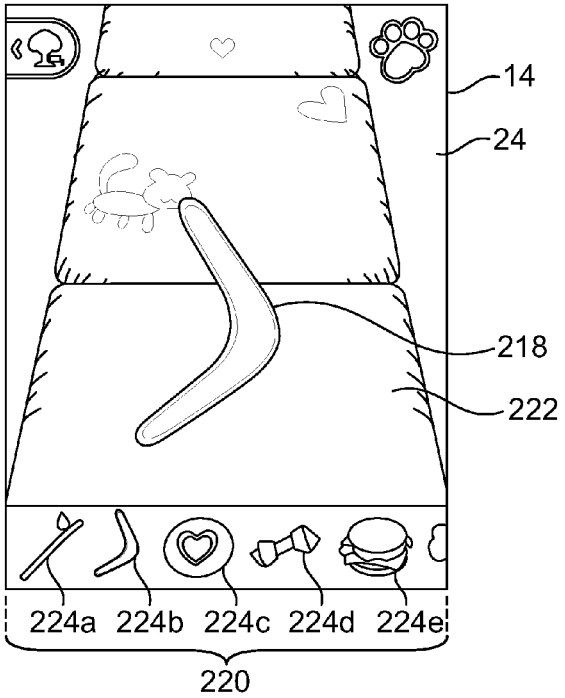
FIG. 7G shows a screen shot of a menu for beginning a fetch utility with a virtual fetch toy and a physical toy character.

For the embodiments shown in FIG. 7E, FIG. 7F and FIG. 7G, the physical character is a physical toy dog, and the player uses a feed utility and a fetch utility to feed the physical toy dog using virtual food and to play fetch with the physical toy dog using a virtual fetch toy. FIG. 7E shows a screen shot of a virtual meal 200 for a physical toy dog. In this screen shot, the player has chosen a virtual meal 200 of spaghetti and meatballs along with a virtual bowl of water 202. For the feed utility in a described embodiment, the player first chooses from a selection of 3 bowls from the bottom menu bar 204. Once the player is happy with the choice, the player presses a checkmark to proceed. Next, the player chooses from a number of base ingredients, including spaghetti, dog biscuits, a cupcake, and ice cream from the bottom menu bar 204. Then they press a checkmark to move on. On the next screen, the player can add toppings to the main ingredient, including fresh vegetables, fruit, sprinkles, etc. The player does this by dragging and dropping the desired toppings onto the main ingredient. The player can add as many toppings as desired. When the player is happy with the choice, the player may press the knife and fork icon 212 to feed the physical toy character. Once the main course is selected, the bottom menu bar 204 shows the dessert selections of virtual ice cream 206, virtual pretzels 208 and virtual popcorn 210.

FIG. 7F shows the player 10 preparing to feed a virtual snack 216 to the physical toy dog 214. The player 10 is shown holding the electronic device 14 and using the touch screen 24 to drag the virtual snack 216 towards the physical toy dog 214. In a described embodiment, when the player 10, drags the virtual snack 216 towards the physical toy dog 214, the virtual snack 216 will disappear from the touch screen 24, and the physical toy dog 214 will make a chomping sound. The bowl will reappear as a half-empty bowl. Moving the virtual snack 216 off the screen again will cause the physical toy dog 214 to chomp some more and return an empty bowl. The physical toy dog 214 will react with satisfaction by barking and moving happily. At the end of the activity, earned credit is displayed.

FIG. 7G shows a screen shot of a menu for beginning a fetch utility with a virtual fetch toy 218 and a physical toy character. In the described embodiment, the player sees a sidewalk 222 on the touch screen 24 of the electronic device 14, and can choose from a selection of classic fetch toys 224*a-e* on a fetch toy menu 220, as well as various treats to throw for the physical toy character. In this example, the player chose a boomerang. The player may swipe the virtual fetch toy 218 across the screen so the toy disappears. After the toy disappears, it returns to the screen a short while later as if the physical toy character had fetched it. The item is returned to the touch screen 24, sometimes the same, sometimes in a changed state. For instance, a dog biscuit might come back with a bite taken out of it, while a boomerang might come back covered in dog drool. During the fetch sequence, the physical toy dog will bark enthusiastically. The physical toy dog will also emit munching or belching sounds if the player has thrown a food item. At the end of the activity, the player will see the credit earned.

In the described embodiments, there are three minigames for the player to play involving both the physical toy character and the virtual toy character. Playing minigames also improves the virtual toy character's status and earns progress. The three minigames are soccer, hide and seek and sing-along. In the soccer minigame, the physical toy character shoots the balls while the virtual toy character tries to defend the goal, and the player decides who to assist. In hide and seek, the player tries to find the virtual toy character on the screen of the electronic device with help from the physical toy character. In sing-along, the player teaches the virtual toy character to sign by hitting the correct notes in a timely manner. With progress, the physical toy character joins the singing. In the described embodiments, each minigame is designed to last around 90 seconds, and all involve some skill from the player. All minigames may have variation so that they are not the same every time they are played, providing replayability for the player.

Figure 8A:
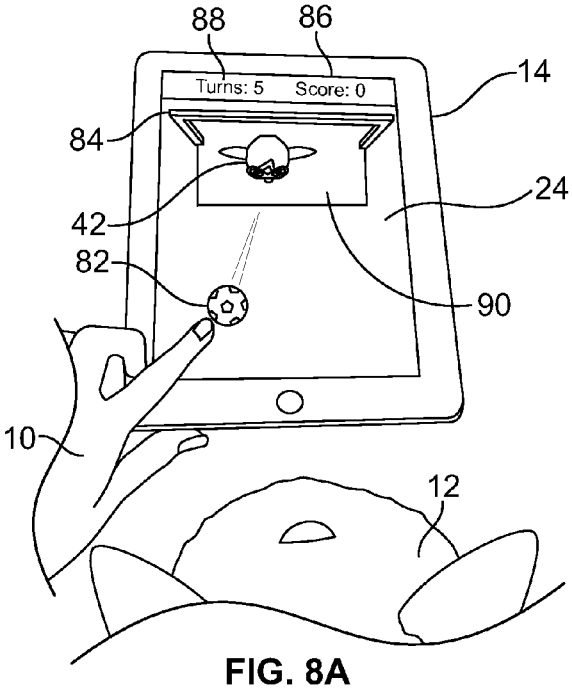
FIG. 8A shows an elevated perspective view of a player, a physical toy character and a virtual toy character playing a game of soccer together.

As an example of a minigame, FIG. 8A shows an elevated perspective view of a player 10, a physical toy character 12 and a virtual toy character 42 playing a game of soccer together. The game begins with a prompt on the touch screen 24 of the electronic device 14 asking the player 10 to choose to play as the physical toy character 12 or as the virtual toy character 42. The player 10 selects using the touch screen 24.

Figure 8B:
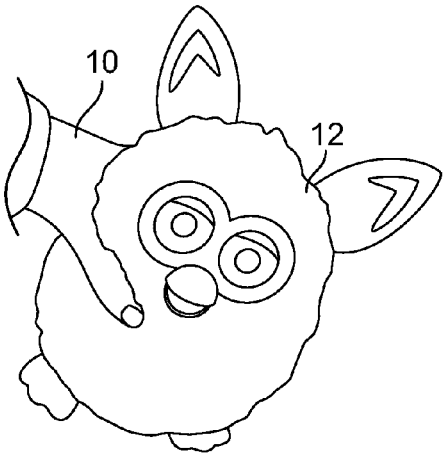
FIG. 8B shows a perspective view of a player manipulating the physical toy character during a game of soccer.

If the player 10 chooses to play as the physical toy character 12, the player 10 is prompted to turn the electronic device 14 around so the goal 84 appears at the top of the touch screen 24. The touch screen 24 is prepared before the game begins. The pitch is displayed with relevant markings. The virtual toy character 42 appears in front of the goal. The touch screen 24 shows the number of points achieved 86 and the number of turns remaining 88. The virtual toy character 42 begins to move left and right along the goal 84 in a predictable motion. In some embodiments, the player cannot select the trajectory of the physical toy character's 12 shot. In other embodiments, the player 10 sets the trajectory of the physical toy character's 12 shot by leaning physical toy character 12 to one side or keeping it upright. FIG. 8B shows a perspective view of a player manipulating the physical toy character 12 during a game of soccer. Note that the player 10 is tilting the physical toy character 12 to choose trajectory. There are set trajectories in which the ball 82 can travel. If the physical toy character 12 is leaned to its left or right, the ball 82 enters the touch screen 24 at a random angle. If the physical toy character 12 is upright, the ball 82 enters from the top center of the touch screen 24 and remains centered as it travels. The player 10 initiates a shot by pulling physical toy character's 12 tail. The tail pull must happen within a few seconds of leaning physical toy character 12 or else it will be assumed it is a centered shot. The player 10 may make the ball travel slightly faster and appear visually different by pulling the tail for a longer period of time. After a brief period while the physical toy character 12 communicates wirelessly with the electronic device 14, the ball 82 is fired onto the touch screen 24. At the same time, the physical toy character 12 reacts by making a spitting sound. If the ball 82 does not collide with the virtual toy character 42, it passes into the goal 84. The ball 82 disappears off-screen behind the virtual toy character 42. The points achieved 86 is increased and turns remaining 88 is decreased. The physical toy character 12 reacts by celebrating. The virtual toy character 42 reacts with disappointment.

If the ball 82 collides with the virtual toy character 42, it is saved, and the ball 82 rebounds back towards the player 10. When the ball 82 is rebounded, the player 10 is able to return fire by using a finger to push the ball 82 back towards the goal 84. The surface area of the touch screen 24 surrounding the player's 10 finger acts as a buffer that, when hit, pushes the ball 82 back. If the player 10 fails to return the ball 82 and score, the points achieved 86 does not change but the turns remaining 88 is decreased. The physical toy character 12 reacts with disappointment, and the virtual toy character 42 reacts by celebrating. The player 10 is able to continue to return fire until the goal is scored or the return is missed.

If the player 10 chooses to play as the virtual toy character 42, the touch screen 24 is prepared before the game begins. The pitch is displayed with relevant markings, and the goal 84 appears at the bottom of the touch screen 24 (not shown). The virtual toy character 42 appears in front of the goal. The touch screen 24 shows the number of points achieved 86 and the number of turns remaining 88. After a brief period, the ball 82 is fired onto the touch screen 24. At the same time, the physical toy character 12 reacts by spitting. The player 10 is able to drag the virtual toy character 42 in any direction (left, right, forwards, and backwards) to try and collide with the ball 82. The virtual toy character 42 cannot be dragged out of the penalty area 90. If the ball 82 collides with the virtual toy character 42, it is saved. The ball 82 rebounds and disappears off the top of the touch screen 24. The points achieved 86 is increased and turns remaining 88 is decreased. The physical toy character 12 reacts with disappointment. The virtual toy character 42 reacts by celebrating. If the ball 82 does not collide with the virtual toy character 42, it passes into the goal 84, and the ball 82 disappears off-screen behind the virtual toy character 42. The turns remaining 88 is decreased and the points achieved 86 does not change. The physical toy character 12 reacts by celebrating, and the virtual toy character 42 reacts with disappointment. After each shot is either scored or saved, the process begins again.

Over the course of the game, the speed of the ball 82 increases and multiple balls are fired in a single turn. The trajectories of the balls also become more complex. The game continues for a set number of turns, and at the end of the game, the final score is displayed. The player earns a rating based on the score.

When a virtual toy character has reached its full potential from the nurturing process, it joins the collection of virtual toy characters in a neighborhood. This always occurs after the player has used a utility or minigame to improve a status. After showing the final progress being added, the virtual toy character celebrates and is shown moving into the neighborhood. From here, the player can view and interact with each previously-raised virtual toy characters.

Figure 8C:
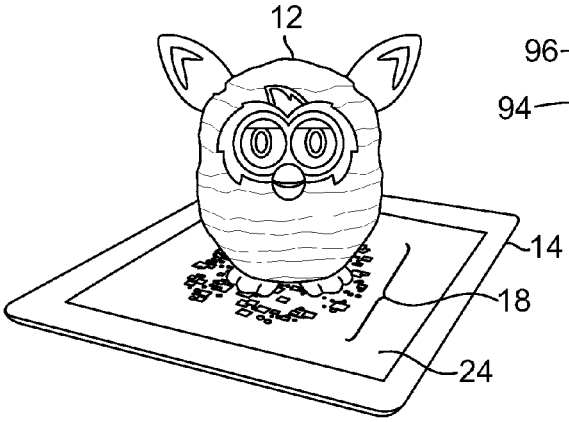
FIG. 8C shows a perspective view of a physical toy character placed onto the touch screen of an electronic device.

In further embodiments, other means of interaction and communication between the player, the physical toy character and the virtual environment may be used to transfer the virtual egg 20. FIG. 8C shows a perspective view of a physical toy character 12 placed onto the touch screen 24 of an electronic device 14. The application running on the electronic device 14 and controlling the virtual environment accepts the touch screen 24 input from the physical toy character 12 and particles 18 form in an egg shape on the touch screen 24 to signify the transfer of a virtual egg.

Figure 9:
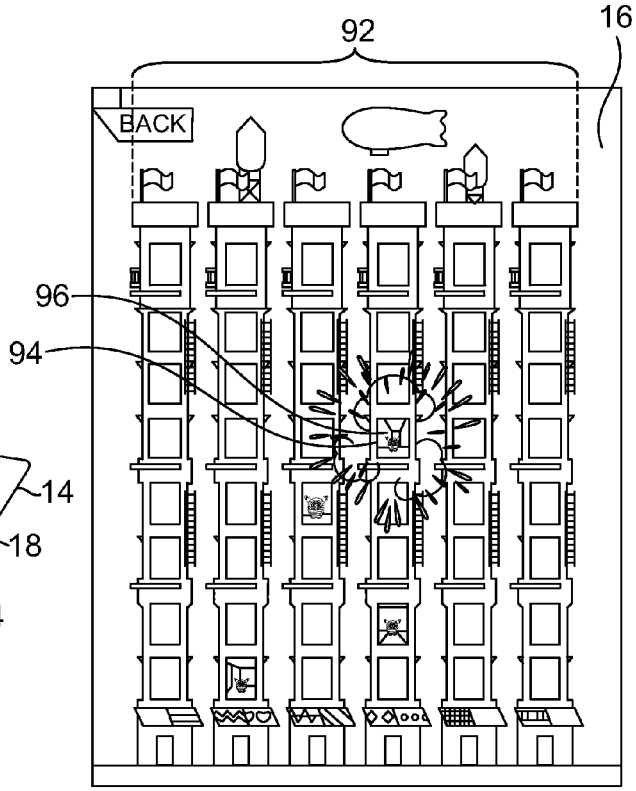
FIG. 9 shows a screen shot of a virtual toy character neighborhood.

FIG. 9 shows a screen shot of a virtual toy character neighborhood 92. As a virtual toy character enters the neighborhood 92, graphical indications appear on the screen 16 around the virtual toy character's apartment 94, and the virtual toy character 96 is seen in the window. The collection of virtual toy characters is organized in the neighborhood 92 to show what has been collected and what has not yet been collected. In the described embodiment, virtual toy characters are organized into tribes, each with their own tower block and a set amount of rooms already in place. Each type of virtual toy character has its own apartment, and when it is added to the neighborhood 92, it appears in its tribe's tower block. The neighborhood 92 provides a way for the player to see all collected virtual toy characters and virtual toy characters that are yet to be collected. It can be browsed at full view or zoomed in to each virtual toy character's individual apartment. At full view, the player is able to see the entire collection at-a-glance. Each tribe is organized into towers that appear alongside each other. The player can zoom in by pinching the touch screen 24 or zoom out by pulling the touch screen 24, and scroll by dragging the touch screen 24. A virtual toy character 96 can be viewed in its apartment 94 by touching it. Its apartment 94 is very similar to the playroom and appears with the same customization that was set during nurturing.

The physical toy character is a driving force behind the game, and the overall progression of the player is represented by leveling up. The physical toy character's level is increased through various actions in the game, such as raising and nurturing a virtual toy character and using utilities to take care of the physical toy character. The physical toy character's level is also directly linked to egg generation. Each time the physical toy character increases a level, it can produce another egg. The higher the level of the physical toy character, the more content becomes accessible, which ultimately allows the player to complete the collection of virtual toy characters. Performing various actions in-game increases the physical toy character's progress towards the next level. Some game features are unlocked once the physical toy character reaches a certain level.

The physical toy character reaches a new level through experience that is attained through hatching an egg, having a virtual toy character join the neighborhood, completing a tribe in the neighborhood, starting a new tribe in the neighborhood, using a utility or using a minigame. When the physical toy character levels up, some game features may be unlocked (e.g. virtual toy character). The player should aim to reach the highest level that unlocks all game features, however there is no limit placed upon how many times a physical toy character can level up, and it should appear infinite to the player. Each time the physical toy character levels up, it takes more experience to reach the next level. This means the physical toy character will level up more often when the player first starts playing and slow down over time.

The described embodiments also provide utilities on the electronic device for the physical toy character to interact with what appears on the screen. As described earlier, the physical toy character may interact with the screen to lay an egg. Other utilities for the physical toy character include a hose for cleaning, a bathroom, a sickbay and a pantry. These utilities further provide for interaction between the player, the physical toy character and the virtual toy character. The physical toy character's current progress and level is represented in the dashboard.

Figure 10:
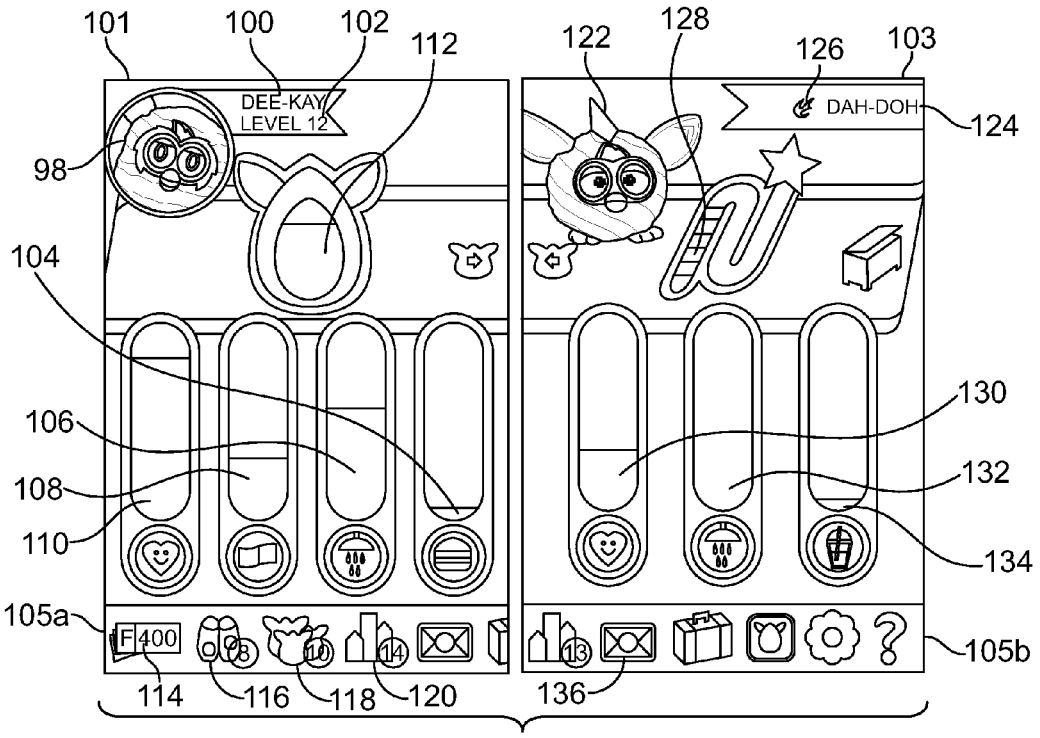
FIG. 10 shows screen shots of electronic dashboards used to show statuses of the physical toy character and the virtual toy character.

FIG. 10 shows screen shots of electronic dashboards used to show statuses of the physical toy character and the virtual toy character. The dashboard serves as the central hub for the game, providing a link to all areas of the game and an overview of the player's statistics and other information. The dashboard is divided into the physical toy character dashboard 101, the virtual toy character dashboard 103 and the toolbar 105*a-b*. The player can toggle between the physical toy character dashboard 101 and the virtual toy character dashboard 103 by swiping or selecting a button. The toolbar 105*a-b* always remains static no matter which dashboard is visible. There are variants of the physical toy character dashboard 101 for when an egg is incubating or when there is neither an egg nor a virtual toy character in progress. In both these versions, the statuses are disabled and the egg dashboard provides a link to the incubator in place of the playroom.

Various information is communicated on the dashboards. To identify the physical toy character, the physical toy character dashboard 101 shows the physical toy character portrait 98, which shows how the physical toy character looks, and the physical toy character name 100. Below the physical toy character name 100, the player can see the game level 102, which is a number from zero upwards. Statuses relating to the physical toy character appear in the physical toy character dashboard 101. Physical toy character hunger status 104 shows how hungry the physical toy character is. Physical toy character cleanliness status 106 shows how clean the physical toy character is and whether it needs washing. Physical toy character toilet status 108 shows how badly the physical toy character needs to use the toilet. Physical toy character happiness status 110 shows how happy the physical toy character is. Above the status bars, the player may see the progress to the next egg 112 to see how much must be done before an egg may be transferred. The lower left corner shows a virtual currency indicator 114 so the player knows how much is available to spend. As part of the game, a player has access to a shop to purchase items used in the game, such as food, cleaning products, playroom items, etc. On the toolbar 105*a* of the physical toy character dashboard 101, the player is shown the number of virtual eggs collected 116, the number of virtual friends 118 that the player has unlocked, and the number of virtual toy characters 120 that the player has.

To identify the virtual toy character, the virtual toy character dashboard 103 shows the virtual toy character portrait 122 and the virtual toy character name 124. Next to the virtual toy character name 124, the player can see the virtual toy character personality 126 that was set during incubation. Below the name, the player can see the virtual toy character's progress in the neighborhood 128. Statuses relating to the virtual toy character also appear in the virtual toy character dashboard 103. Virtual toy character happiness status 130 shows how happy the virtual toy character is.

Virtual toy character cleanliness status 132 shows how clean the virtual toy character is and whether it needs washing. Virtual toy character hunger status 134 shows how hungry the virtual toy character is. On the toolbar 105*b* of the virtual toy character dashboard 103, the player is shown that an email 136 is available.

In addition to the basic information displayed, the dashboards also communicate when there is an update or an area of the game that needs attention (e.g. when a new virtual friend has been unlocked). When at the dashboard, the physical toy character may react to a number of scenarios, such as if an egg is available for transfer, if a new virtual friend is unlocked, if an egg needs attention, or if a virtual toy character needs attention.

The dashboard provides the link to most areas of the game. In the described embodiment the following places or functions can be directly accessed from the dashboard: 1) utilities for the physical toy character, which includes the sickbay, the restroom, or "Poop Station", the hose, or cleaning station, and the pantry; 2) egg transfer if egg has been earned; 3) the incubator if an egg is currently incubating; 4) the playroom if a virtual toy character is in progress; 5) minigames, which includes soccer, hide and seek, and sing-along; 6) utilities for the virtual toy character, which includes, a blender, or feeding station and a spa; 7) a shop for making purchases; 8) the egg carton; 8) a virtual book of friends; 9) the neighborhood; 10) email; 11) gadgets for the physical toy character, which include a dictionary, a translator, a voice changer, a video maker, and a sleeping aid; 12) a boombox; 13) a hypnotizer; 14) unlockable bonuses; 15) settings and options; and 16) help.

The dashboard must be updated to show the physical toy character's current statuses. This happens automatically whenever the player starts up the game, but future updates can only be applied using a 'refresh' option in the Settings & Options. If the player starts the game without physical toy character, the dashboard cannot be updated. In this circumstance, the dashboard is shown with the statuses inactive or out-of-date.

When at the dashboard, the physical toy character may react to a number of scenarios, including 1) an egg available for transfer; 2) a newly unlocked virtual toy character; 3) an egg needing attention; 4) a virtual toy character needing attention; and 5) a full moon. The player can find extra unlockable objects by purchasing or finding items in the real world. The player can scan in objects via a QR code or receive tones from special physical toy characters. Items that can be unlocked include promotional eggs, additional food items for the pantry, and additional objects for the playroom. The option to unlock objects can be selected from a dashboard. There are two ways for the player to choose to unlock objects: 1) via QR barcode scanning; or 2) using tones or other wireless signals sent by the physical toy characters to the application running on the electronic device. The player is asked to choose a method upon selecting the option to unlock objects. As well as scanning in promotional eggs from real world products, other in-game objects can be unlocked by scanning a code as described earlier with reference to FIG. 2. Among the unlockable object types are promotional eggs, virtual toy characters with pre-determined flair, food items for the pantry, and themes and items for the playroom, for example. Aside from the promotional eggs, the other unlockable items are not alluded to in the game until they are unlocked. This means the player does not see the item as a potential object for use in-game until it has been discovered and scanned in.

Figure 11A:
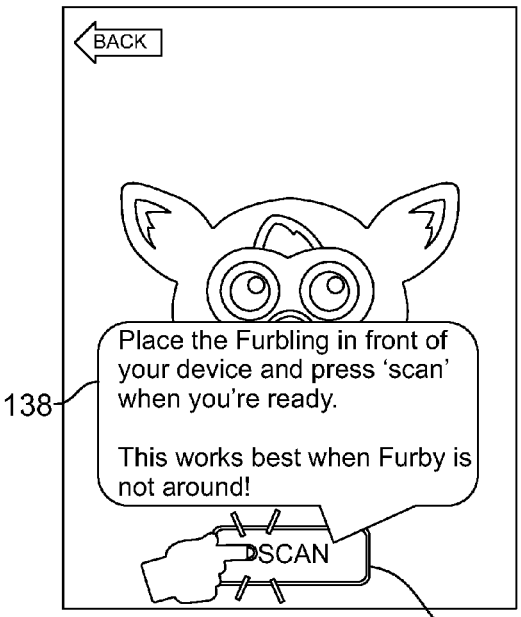
FIG. 11A shows a screen shot for wirelessly unlocking objects.
Figure 11B:
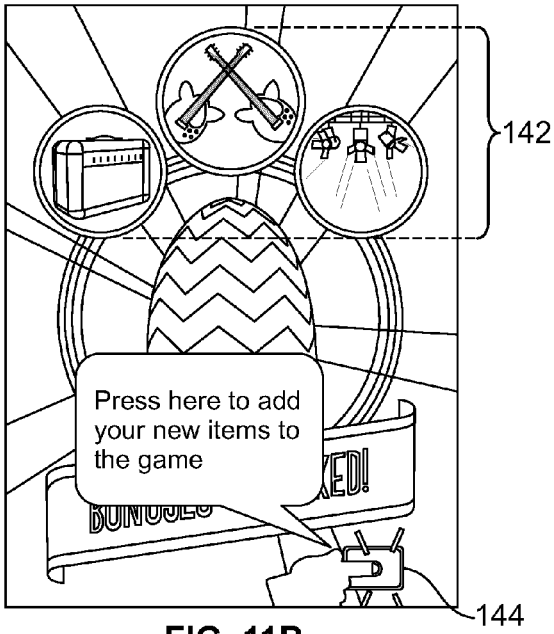
FIG. 11B shows a screen shot of a menu for selecting unlocked objects.

FIG. 11A shows a screen shot for wirelessly unlocking objects. All objects are unlocked by using the toy to communicate via tones or other wireless signals. The player is prompted with scanning instructions 138 telling the player to place the toy in front of the electronic device and allow it to send a unique tone that decides what objects will unlock. When the player presses the scan button 140, the communication begins. FIG. 11B shows a screen shot of a menu for selecting unlocked objects 142. In order for the player to add the unlocked objects 142 to the game, the player must press the add items button 144. Then, the player may return to the game to use the unlocked objects. When an object has been unlocked, a confirmation message is presented showing the player a preview of the unlocked objects 142. The player is returned to the dashboard after dismissing the confirmation message. In some cases, as shown in FIG. 11B, multiple items are unlocked. In this instance, a confirmation screen displays multiple items. If the player has already unlocked one or more of the object by a previous unlock or by purchasing the item from the shop, this is ignored and the unlock screen is still displayed. Also, the player is able to get multiple eggs from a virtual toy character by continued unlocking. If one of the unlocked objects 142 is an egg and the egg carton is full, the process fails, no items are unlocked, and an error message is displayed. The player must create a space in the egg carton before trying again. If the unlocked object 142 is a virtual toy character and the player already has five of this type, the process fails. No items are unlocked, and an error message is displayed. The player must create a space in the neighborhood by deleting a virtual toy character before trying again.

Figure 12:
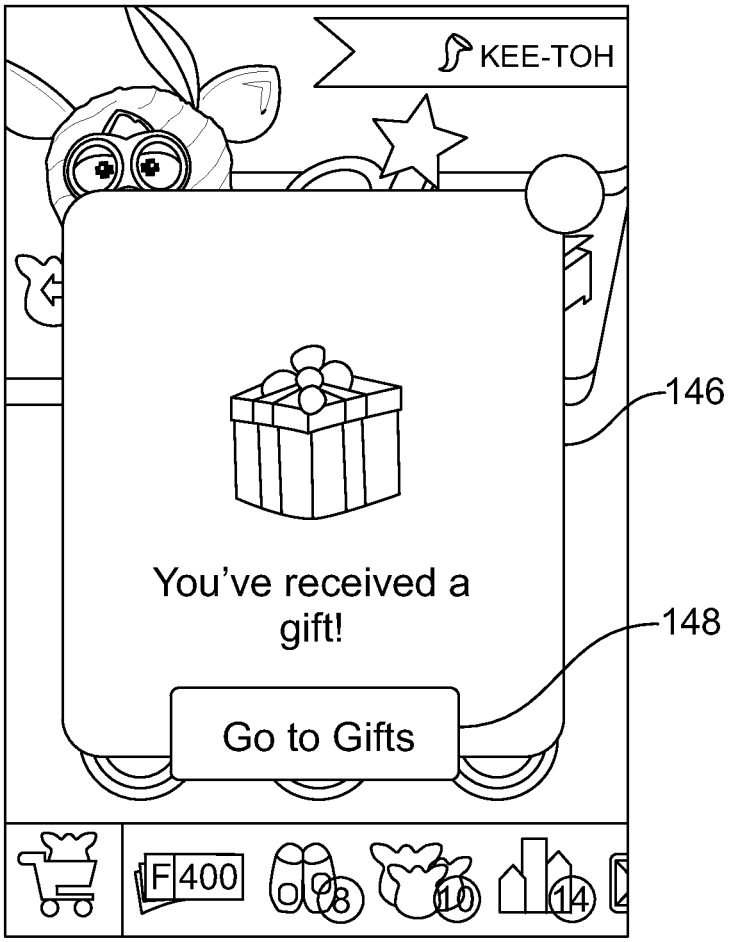
FIG. 12 shows a screen shot notifying the player and the virtual toy character that the virtual toy character received a free gift.

Collectable packages, or gifts, are rewards for the player that are given at various points throughout the game as further progress is made. After earning a package, or gift, the player must unwrap it to see what it is and use it. This can be done using a physical toy character, or, alternatively, by spending currency. The packages are stored in a section of the game that is accessed from the dashboard. The package collection area shows how many packages are available, which packages have been collected so far, and which packages have been unwrapped for use. To earn a package, the player must hatch virtual toy characters. After each virtual toy character has been hatched and named, a package is unlocked. In the described embodiment, for the first eight packages, one is earned after every hatched virtual toy character. For the next eight, it occurs after every other virtual toy character is hatched, meaning it takes a total of twenty-four hatchings to unlock sixteen packages. FIG. 12 shows a screen shot notifying the player and the virtual toy character that the virtual toy character received a free gift. The dialog box 146 informs the player about the gift, and the get gift button 148 must be pressed to access the gift.

After pressing the get gift button 148, the wrapped package is displayed on screen and the player must fling it towards the physical toy character. Upon receiving the wrapped gift, the physical toy character reacts by sounding like it is chomping and spitting out wrapping paper before sending the unwrapped package back. In the described embodiment, the unwrapped package appears in a big transitional sequence that builds up to a burst screen presented to the player.

Figure 13:
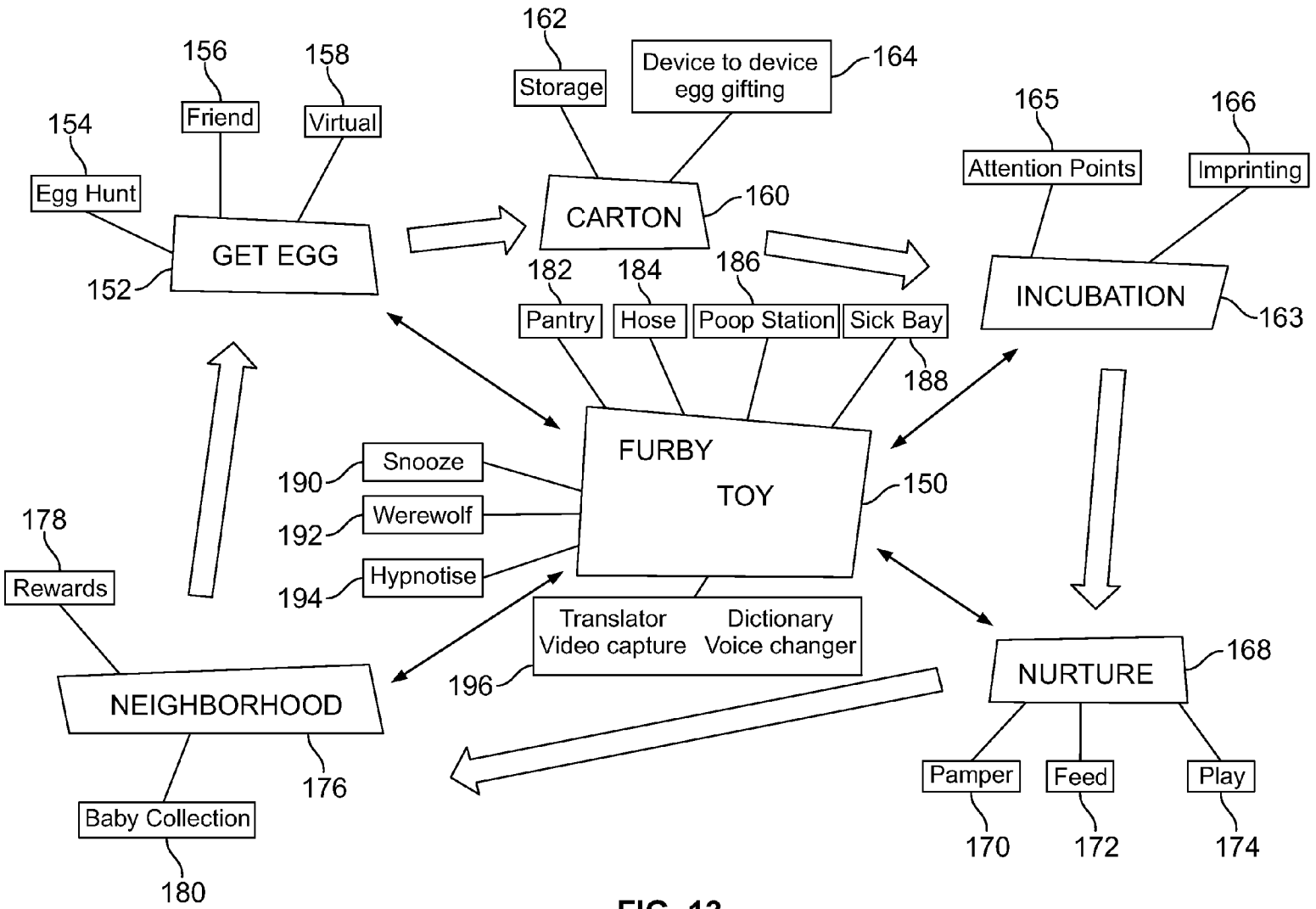
FIG. 13 shows the game flow cycle of a described embodiment.

In sum, FIG. 13 shows the game flow cycle of a described embodiment. The physical toy character 150 begins its interaction with the virtual environment when the virtual environment is in a get egg state 152, and the virtual environment can receive an egg from the physical toy character 150. The get egg state 152 may also receive eggs from an egg hunt 154, from a friend 156 or from a virtual toy character 158. When an egg is received in the get egg state 152, it is placed in the virtual egg carton 160 for storage 162 or to be sent to someone with device to device egg gifting 164. If not in storage 162 or ready for device to device egg gifting 164, the egg begins incubation 163, where the player and the physical toy character 150 must interact with the egg and address attention points 165 or provide imprinting 166. Following incubation 163, the egg hatches and begins to nurture 168, where it interacts with the player and the physical toy character 150 for pampering 170, feeding 172 and playing 174. Once the hatchling is nurtured and matured, it moves to the neighborhood 176, where the matured virtual toy character interacts with the physical toy character to get rewards 178 or to create a baby collection 180. Once in the neighborhood 176, the virtual toy character may interact with the get egg state 152 and begin minding a virtual egg with the player and the physical toy character 150.

Also shown in FIG. 13, the physical toy character 150 interacts with the virtual environment to take a snooze 190, turn into a werewolf 192, or get hypnotized 194. The physical toy character 150 may also interact with the virtual environment to access the pantry 182, a hose 184 for cleaning, a bathroom or poop station 186, or a sick bay 188. Another portion of the virtual environment allows the physical toy character 150 to access utilities 196 such as a dictionary, a voice changer, a video capture tool and a translator.

While the present inventions have been illustrated by a description of various embodiments and while these embodiments have been set forth in considerable detail, it is intended that the scope of the inventions be defined by the appended claims. It will be appreciated by those skilled in the art that modifications to the foregoing preferred embodiments may be made in various aspects. It is deemed that the spirit and scope of the inventions encompass such variations to be preferred embodiments as would be apparent to one of ordinary skill in the art and familiar with the teachings of the present application.

What is claimed is:

1. A system for interaction between a user and a plurality of toys comprising:

an interactive physical toy character comprising:

a first sensor for detecting predetermined sensory input to the physical toy character and for generating signals corresponding to the sensory input;

circuitry for responding to signals from the first sensor; and a first transmitter for transmitting predetermined electronic communications signals in response to signals from the first sensor; and an electronic device comprising:

a plurality of second sensors for detecting predetermined sensory inputs to the electronic device;

a second receiver for receiving predetermined electronic communications signals from the physical toy character;

a second transmitter for transmitting predetermined electronic communications signals to the physical toy character in response to signals from the second sensors and in response to signals received by the second receiver;

a virtual environment comprising environmental attributes that change in response to signals from the second sensors and in response to signals received by the second receiver; and a virtual toy character comprising a virtual egg with character attributes that change for hatching in response to the virtual environment.

2. The system recited in claim 1 wherein the circuitry for responding further comprises:

a plurality of first sensors for detecting predetermined sensory inputs to the physical toy character and for generating signals corresponding to the sensory inputs;

a first receiver for receiving predetermined electronic communications signals into the physical toy character;

circuitry for responding to signals received by the first receiver;

the first transmitter further transmitting predetermined electronic communications signals in response to signals from the first sensors and in response to signals received by the first receiver;

sound generating circuitry for responding to signals from the first sensors and for responding to signals received by the first receiver;

light generating circuitry for responding to signals from the first sensors and for responding to signals received by the first receiver; and movement generating circuitry for responding to signals from the first sensors and for responding to signals received by the first receiver.

3. The system recited in claim 1 wherein the changes to character attributes cause the virtual egg to hatch and release a virtual baby offspring.

4. The system recited in claim 3 wherein the virtual egg is earned into the virtual environment because of interaction between a user and the physical toy character.

5. The system recited in claim 3 wherein changes to character attributes give the virtual egg a personality.

6. The system recited in claim 3 wherein the virtual egg provides visual and auditory responses to interactions with the user and the physical toy character.

7. The system recited in claim 3 wherein when the virtual egg hatches it acquires character attributes resembling character attributes from the physical toy character.

8. The system recited in claim 3 further comprising user-touchable areas in the virtual environment that initiate activities in the virtual environment involving the user, the physical toy character and the virtual toy character such as feeding, grooming, toilet training and playing with the virtual toy character.

9. The system recited in claim 1 further comprising a dashboard in the virtual environment that displays statistics and progress related to the physical toy character, the virtual toy character and the virtual environment and that acts as a central hub by providing links to all areas of the game.

10. The system recited in claim 1 further comprising a plurality of users, a plurality of physical toy characters and a plurality of virtual toy characters.

11. The system recited in claim 1 further comprising virtual objects locked in the virtual environment that become unlocked in response to one of a scanned code and auditory tones.

12. The system recited in claim 3 further comprising locked virtual gift packages that become unlocked in response to one of a virtual egg hatching and a three-way interaction between the user, the physical toy character and the virtual environment.

13. The system recited in claim 1 further comprising virtual currency earned from interaction with the virtual toy character that is spendable in the virtual environment to purchase virtual objects.

14. A method for interaction between a user and a plurality of toys comprising:

providing an interactive physical toy character comprising:

detecting predetermined sensory inputs to the physical toy character and generating signals corresponding to the sensory inputs with a plurality of first sensors;

receiving predetermined electronic communications signals into the physical toy character into a first receiver;

providing circuitry for responding to signals from the first sensors and for responding to signals received by the first receiver; and transmitting predetermined electronic communications signals in response to signals from the first sensors and in response to signals received by the first receiver with a first transmitter; and providing an electronic device comprising:

detecting predetermined sensory inputs to the electronic device with a plurality of second sensors;

receiving predetermined electronic communications signals from the physical toy character with a second receiver;

transmitting predetermined electronic communications signals to the physical toy character in response to signals from the second sensors and in response to signals received by the second receiver with a second transmitter;

providing a virtual environment comprising environmental attributes that change in response to signals from the second sensors and in response to signals received by the second receiver;

providing a virtual toy character comprising a virtual egg with character attributes that change for hatching in response to the virtual environment; and providing a dashboard in the virtual environment that displays statistics and progress related to the physical toy character, the virtual toy character and the virtual environment and that acts as a central hub by providing links to all areas of the game.

15. The method recited in claim 14 wherein the changes to character attributes include the virtual egg hatching a virtual baby offspring.

16. A method for interaction between a user and a plurality of toys comprising:

providing an interactive physical toy character comprising:

detecting predetermined sensory inputs to the physical toy character and generating signals corresponding to the sensory inputs with a plurality of first sensors;

receiving predetermined electronic communications signals into the physical toy character into a first receiver;

providing circuitry for responding to signals from the first sensors and for responding to signals received by the first receiver; and transmitting predetermined electronic communications signals in response to signals from the first sensors and in response to signals received by the first receiver with a first transmitter; and providing an electronic device comprising:

detecting predetermined sensory inputs to the electronic device with a plurality of second sensors;

receiving predetermined electronic communications signals from the physical toy character with a second receiver;

transmitting predetermined electronic communications signals to the physical toy character in response to signals from the second sensors and in response to signals received by the second receiver with a second transmitter;

providing a virtual environment comprising environmental attributes that change in response to signals from the second sensors and in response to signals received by the second receiver; and providing a virtual toy character comprising a virtual egg with character attributes that change for hatching in response to the virtual environment.

17. The method recited in claim 16 providing the virtual toy character with character attributes that change in response to signals from the second sensors, in response to signals received by the second receiver and in response to changes in the virtual environment; and providing a dashboard in the virtual environment that displays statistics and progress related to the physical toy character, the virtual toy character and the virtual environment and that acts as a central hub by providing links to all areas of the game.

18. The method recited in claim 16 wherein the changes to character attributes including the virtual egg hatching a virtual baby offspring.

19. The method recited in claim 16 providing user-touchable areas in the virtual environment that initiate activities in the virtual environment involving the physical toy character and the virtual toy character for training and playing with the virtual toy character.

20. The method recited in claim 14 further providing user-touchable areas in the virtual environment that initiate activities in the virtual environment involving the physical toy character and the virtual egg.

* * * * *